US008139959B2

(12) United States Patent
Sato et al.

(10) Patent No.: US 8,139,959 B2
(45) Date of Patent: Mar. 20, 2012

(54) PRINT MANAGING APPARATUS, SYSTEM, AND PROGRAM

(75) Inventors: Takahisa Sato, Yamato-Koriyama (JP); Masashi Toyoda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 574 days.

(21) Appl. No.: 11/959,517

(22) Filed: Dec. 19, 2007

(65) Prior Publication Data

US 2008/0159769 A1 Jul. 3, 2008

(30) Foreign Application Priority Data

Dec. 28, 2006 (JP) ..... 2006-355581

(51) Int. Cl.
*G03G 15/00* (2006.01)

(52) U.S. Cl. ..... 399/8; 399/80; 399/405

(58) Field of Classification Search ..... 399/8, 80, 399/381, 397, 405
See application file for complete search history.

(56) References Cited

FOREIGN PATENT DOCUMENTS

| | | |
|---|---|---|
| CN | 1728077 | 2/2006 |
| JP | 2000-155506 | 6/2000 |
| JP | 2005-044018 | 2/2005 |
| JP | 2005-201968 | 7/2005 |
| JP | 2006-043898 | 2/2006 |
| JP | 2006-224306 | 8/2006 |
| JP | 2007-171254 | 7/2007 |

OTHER PUBLICATIONS

U.S. Appl. No. 11/876,174, filed Oct. 22, 2007.

*Primary Examiner* — David Porta
*Assistant Examiner* — Benjamin Schmitt
(74) *Attorney, Agent, or Firm* — Renner, Otto, Boisselle & Sklar, LLP

(57) ABSTRACT

A management server is connected to an MFP and a client PC through LAN. The management server includes a leaving information acquiring portion that acquires leaving information related to recording paper sheets left unremoved for each print job accepted by the MFP, a leaving information count portion that counts the acquired leaving information for each user, and a warning portion that transmits warning information for prompting a user not to leave a recording paper sheet. The leaving information count portion counts the number of print jobs associated with the detection of the recording paper sheets left unremoved for each time zone based on the leaving detection time and the user ID from the leaving information acquiring portion, and when accepting a print job from a client PC, the warning portion transmits warning information to the client PC for a user having the counted number not less than a predetermined number.

15 Claims, 23 Drawing Sheets

FIG. 8A

INFORMATION SENT FROM MFP TO SERVER (WHEN PRINT JOB ARRIVES)

| JOB NUMBER | USER ID | MFP NUMBER |
|---|---|---|
| JOB1 | C12345 | MFP1 |
| JOB2 | D54321 | MFP2 |

SERVER'S TABLE (LEAVING HISTORY TABLE) 103a

| n | JOB NUMBER (ADD) | USER ID (ADD) | MFP NUMBER (ADD) | TIME T1 WHEN PRESENCE OF RECORDING PAPER SHEET IS INITIALLY DETECTED | LEAVING TIME EXCESS FLAG |
|---|---|---|---|---|---|
| 1 | JOB1 | C12345 | MFP1 | — | — |
| 2 | JOB2 | D54321 | MFP2 | — | — |

FIG. 8B

INFORMATION SENT FROM MFP TO SERVER (WHEN LEAVING IS DETECTED) (TRANSMITTED ONLY FOR JOB ASSOCIATED WITH RECORDING PAPER SHEET LEFT UNREMOVED (JOB1))

| JOB NUMBER | MFP NUMBER |
|---|---|
| JOB1 | MFP1 |

SERVER'S TABLE (LEAVING HISTORY TABLE) 103a (RECEIVED AT 12:10)

| n | JOB NUMBER | USER ID | MFP NUMBER | TIME T1 WHEN PRESENCE OF RECORDING PAPER SHEET IS INITIALLY DETECTED (UPDATED) | LEAVING TIME EXCESS FLAG (UPDATED) |
|---|---|---|---|---|---|
| 1 | JOB1 | C12345 | MFP1 | 12:10 | EXCEED |
| 2 | JOB2 | D54321 | MFP2 | — | — |

FIG. 9A

INFORMATION SENT FROM MFP TO SERVER (WHEN PRINT JOB ARRIVES)

| JOB NUMBER | USER ID | MFP NUMBER |
|---|---|---|
| JOB1 | C12345 | MFP1 |
| JOB2 | D54321 | MFP2 |

SERVER'S TABLE (LEAVING HISTORY TABLE) 103a (ADD) (ADD) (ADD)

| n | JOB NUMBER | USER ID | MFP NUMBER | TIME T1 WHEN PRESENCE OF RECORDING PAPER SHEET IS INITIALLY DETECTED | TIME T2 WHEN PRESENCE OF RECORDING PAPER SHEET IS LASTLY DETECTED | LEAVING TIME (T2−T1) | LEAVING TIME EXCESS FLAG ("EXCEED" IF LEAVING TIME IS 20 MINUTES OR MORE) |
|---|---|---|---|---|---|---|---|
| 1 | JOB1 | C12345 | MFP1 | — | — | — | — |
| 2 | JOB2 | D54321 | MFP2 | — | — | — | — |

FIG. 9B

INFORMATION SENT FROM MFP TO SERVER (WHEN LEAVING IS DETECTED) FIRST TIME (TRANSMITTED ONLY FOR JOB ASSOCIATED WITH RECORDING PAPER SHEET LEFT UNREMOVED (JOB1))

| JOB NUMBER | MFP NUMBER |
|---|---|
| JOB1 | MFP1 |

SERVER'S TABLE (LEAVING HISTORY TABLE) 103a (RECEIVED AT 12:10) (UPDATED)

| n | JOB NUMBER | USER ID | MFP NUMBER | TIME T1 WHEN PRESENCE OF RECORDING PAPER SHEET IS INITIALLY DETECTED | TIME T2 WHEN PRESENCE OF RECORDING PAPER SHEET IS LASTLY DETECTED | LEAVING TIME (T2−T1) | LEAVING TIME EXCESS FLAG ("EXCEED" IF LEAVING TIME IS 20 MINUTES OR MORE) |
|---|---|---|---|---|---|---|---|
| 1 | JOB1 | C12345 | MFP1 | 12:10 | — | — | — |
| 2 | JOB2 | D54321 | MFP2 | — | — | — | — |

FIG. 9C

INFORMATION SENT FROM MFP TO SERVER (WHEN PRINT JOB ARRIVES) SECOND TIME

| JOB NUMBER | MFP NUMBER |
|---|---|
| JOB1 | MFP1 |

SERVER'S TABLE (LEAVING HISTORY TABLE) (RECEIVED AT 12:40)

103a

| n | JOB NUMBER | USER ID | MFP NUMBER | TIME T1 WHEN PRESENCE OF RECORDING PAPER SHEET IS INITIALLY DETECTED (UPDATED) | TIME T2 WHEN PRESENCE OF RECORDING PAPER SHEET IS LASTLY DETECTED (UPDATED) | LEAVING TIME (T2−T1) (UPDATED) | LEAVING TIME EXCESS FLAG ("EXCEED" IF LEAVING TIME IS 20 MINUTES OR MORE) (UPDATED) |
|---|---|---|---|---|---|---|---|
| 1 | JOB1 | C12345 | MFP1 | 12:10 | 12:40 | 0:30 | EXCEED |
| 2 | JOB2 | D54321 | MFP2 | — | — | — | — |

FIG. 9D

INFORMATION SENT FROM MFP TO SERVER (WHEN PRINT JOB ARRIVES) THIRD TIME

| JOB NUMBER | MFP NUMBER |
|---|---|
| | |

SERVER'S TABLE (LEAVING HISTORY TABLE) (RECEIVED AT 13:10)

103a

| n | JOB NUMBER | USER ID | MFP NUMBER | TIME T1 WHEN PRESENCE OF RECORDING PAPER SHEET IS INITIALLY DETECTED | TIME T2 WHEN PRESENCE OF RECORDING PAPER SHEET IS LASTLY DETECTED | LEAVING TIME (T2−T1) | LEAVING TIME EXCESS FLAG ("EXCEED" IF LEAVING TIME IS 20 MINUTES OR MORE) |
|---|---|---|---|---|---|---|---|
| 1 | JOB1 | C12345 | MFP1 | 12:10 | 12:40 | 0:30 | EXCEED |
| 2 | JOB2 | D54321 | MFP2 | — | — | — | — |

FIG. 10

| USER ID | | | APPARATUS | | |
|---|---|---|---|---|---|
| | | | MFP1 | MFP2 | SUBTOTAL |
| C12345 | TIME ZONE | MORNING | 10 | 1 | 11 |
| | | AFTERNOON | 2 | 1 | 3 |
| | | SUBTOTAL | 12 | 2 | TOTAL 14 |
| D54321 | TIME ZONE | MORNING | 0 | 3 | 3 |
| | | AFTERNOON | 2 | 1 | 3 |
| | | SUBTOTAL | 2 | 4 | TOTAL 6 |

103b

FIG. 19A

INFORMATION SENT FROM MFP TO SERVER (WHEN PRINT JOB ARRIVES)

| JOB NUMBER | USER ID | MFP NUMBER | IMPORTANCE |
|---|---|---|---|
| JOB1 | C12345 | MFP1 | HIGH |
| JOB2 | D54321 | MFP2 | — |

SERVER'S TABLE (LEAVING HISTORY TABLE) 103a

| n | JOB NUMBER (ADD) | USER ID (ADD) | MFP NUMBER (ADD) | IMPORTANCE (ADD) | TIME T1 WHEN PRESENCE OF RECORDING PAPER SHEET IS INITIALLY DETECTED | TIME EXCESS FLAG |
|---|---|---|---|---|---|---|
| 1 | JOB1 | C12345 | MFP1 | HIGH | — | — |
| 2 | JOB2 | D54321 | MFP2 | | — | — |

FIG. 19B

INFORMATION SENT FROM MFP TO SERVER (WHEN LEAVING IS DETECTED) (TRANSMITTED ONLY FOR JOB ASSOCIATED WITH RECORDING PAPER SHEET LEFT UNREMOVED (JOB1))

| JOB NUMBER | MFP NUMBER |
|---|---|
| JOB1 | MFP1 |

SERVER'S TABLE (LEAVING HISTORY TABLE) 103a
(RECEIVED AT 12:10)

| n | JOB NUMBER | USER ID | MFP NUMBER | IMPORTANCE | TIME T1 WHEN PRESENCE OF RECORDING PAPER SHEET IS INITIALLY DETECTED | TIME EXCESS FLAG |
|---|---|---|---|---|---|---|
| 1 | JOB1 | C12345 | MFP1 | HIGH | 12:10 | EXCEED |
| 2 | JOB2 | D54321 | MFP2 | | — | — |

FIG. 20A

WITHOUT IMPORTANCE

| USER ID | | | APPARATUS | | |
|---|---|---|---|---|---|
| | | | MFP1 | MFP2 | SUBTOTAL |
| C12345 | TIME ZONE | MORNING | 10 | 1 | 11 |
| | | AFTERNOON | 2 | 1 | 3 |
| | | SUBTOTAL | 12 | 2 | TOTAL 14 |
| D54321 | TIME ZONE | MORNING | 0 | 3 | 3 |
| | | AFTERNOON | 2 | 1 | 3 |
| | | SUBTOTAL | 2 | 4 | TOTAL 6 |

103b

FIG. 20B

IMPORTANCE (HIGH)

| USER ID | | | APPARATUS | | |
|---|---|---|---|---|---|
| | | | MFP1 | MFP2 | SUBTOTAL |
| C12345 | TIME ZONE | MORNING | 8 | 0 | 8 |
| | | AFTERNOON | 2 | 2 | 4 |
| | | SUBTOTAL | 10 | 2 | TOTAL 12 |
| D54321 | TIME ZONE | MORNING | 1 | 0 | 1 |
| | | AFTERNOON | 3 | 1 | 4 |
| | | SUBTOTAL | 4 | 1 | TOTAL 5 |

103b

PRINT MANAGING APPARATUS, SYSTEM, AND PROGRAM

CROSS-NOTING PARAGRAPH

This Non-provisional application claims priority under 35 U.S.C. §119(a) on Patent Application No. 2006-355581 filed in JAPAN on Dec. 28, 2006, the entire contents of which are hereby incorporated herein by reference.

FIELD OF THE INVENTION

The present invention relates generally to a print managing apparatus, a system, and a program, and, more particularly, to a print managing apparatus that gives a warning to a user who frequently leaves the printed paper sheets in a tray for a long time based on a leaving history of each user when receiving a print job to prevent prints from being left in the paper discharge tray, a print managing system including the apparatus, and a program.

BACKGROUND OF THE INVENTION

Generally, image forming apparatuses are known that are connected through a network, etc. to terminal apparatuses such as personal computers (PC) and forms images (prints) from image data transmitted from the terminal apparatuses. For example, when printing image data created by a terminal apparatus, a user operates the terminal apparatus to transmit a print instruction to an image forming apparatus. The image forming apparatus received the print instruction, prints the image data from the terminal apparatus on a recording paper sheet, and discharges printed paper sheets having images formed thereon into a predetermined paper discharge tray.

The user directly looks at the paper discharge tray of the image forming apparatus to check whether the image formation is completed and the printed paper sheets have been discharged in the paper discharge tray. If paper sheets are discharged, the user takes out his/her printed paper sheets from the paper discharge tray. In this manner, when the user wants to know whether his/her printed paper sheets have been discharged in the paper discharge tray of the image forming apparatus, he/she must always or at an arbitrary timing, directly look at the paper discharge tray, and that is a cumbersome work to the user.

On the other hand, if a user forgets to take his/her printed paper sheets out of the paper discharge tray, the printed paper sheets will be left in the paper discharge tray for a long time. Therefore, if a malicious third party exists, the third party may peep at the contents of the printed paper sheets left in the tray or take them out with him/her, and that increases the risk of leakage of important information. Furthermore, if the printed paper sheets are discharged over the allowable amount of discharged paper for the paper discharge tray, an accumulation amount detecting portion detects the excess to discontinue the printing, and therefore, if the discharged paper sheets are accumulated in the tray without being taken out, the amount of the discharged paper sheets eventually exceeds the allowable amount of discharged paper for the paper discharge tray as described above and causes such a problem as a discontinuation of printing.

In this regard, a printer output bin management system described in Japanese Laid-Open Patent Publication No. 2000-044018 is known as a technology of detecting that a recording paper sheet is left in a paper discharge tray to prevent a user from forgetting to take the paper sheets out of the paper tray. In this system, a print server allocates a discharge bin and gives a user a notice of prompting a user to collect his/her discharged paper sheets when the server detects that the discharged paper sheets are left in the tray for a predetermined time or longer.

Japanese Laid-Open Patent Publication No. 2000-155506 describes an image forming apparatus including a function of synthetically printing an ID image corresponding to a user on a recording paper sheet and reading the ID image to notify the terminal of the user corresponding to the ID image that the recording paper sheet is left in the paper tray.

However, the technologies described in Japanese Laid-Open Patent Publication Nos. 2000-044018 and 2000-155506 are measures to notify a user that he/she forgets to take his/her recording paper sheet out of the tray when it is detected that his/her recording paper sheet is left in a paper discharge tray, and the technologies are not intended to prevent the recording paper sheets from being left in the tray for a long time, beforehand.

SUMMARY OF THE INVENTION

It is therefore the object of the present invention to provide a print managing apparatus capable of giving a warning to a user who frequently leaves his/her printed paper sheets in the paper discharge tray for a long time based on a leaving history of each user when receiving a print job to prevent his/her discharged paper sheets from being left in a paper discharge tray, a print managing system including the apparatus, and a program.

Another object of the present invention is to provide a print managing apparatus that can be connected through a network to an image forming apparatus having a leaving detecting portion to detect that a recording paper sheet discharged/stacked in a paper discharge tray is left in the tray, and comprises a leaving information acquiring portion that acquires leaving information related to recording paper sheets left in a paper discharge tray for each print job accepted by the image forming apparatus and a leaving information count portion that counts the acquired leaving information for each user.

Another object of the present invention is to provide the print managing apparatus, wherein the leaving information includes a leaving detection time, which is a time when the image forming apparatus detects that the recording paper sheet is left in the paper discharge tray.

Another object of the present invention is to provide the print managing apparatus, wherein the leaving information includes a user ID for identifying a user who leaves the recording paper sheet in the tray.

Another object of the present invention is to provide the print managing apparatus, wherein the leaving information acquiring portion acquires a leaving detection time, which is a time when the image forming apparatus detects that the recording paper sheet is left in the paper discharge tray, and a user ID for identifying a user who leaves the recording paper sheet in the tray as the leaving information, and wherein the leaving information count portion counts the number of print jobs associated with the detection of the recording paper sheets left in the tray for every time zone based on the leaving detection time and the user ID.

Another object of the present invention is to provide the print managing apparatus, wherein the leaving information acquiring portion acquires a leaving detection time, which is a time when the image forming apparatus detects that the recording paper sheet is left unremoved, and a user ID for identifying a user who leaves the recording paper sheet in the tray as the leaving information, and the leaving information count portion counts the number of print jobs associated with the detection of the recording paper sheets left in the tray for a predetermined time or longer after the first detection of leaving for every time zone based on the leaving detection time and the user ID.

Another object of the present invention is to provide the print managing apparatus, wherein the leaving information acquiring portion acquires a leaving detection time, which is a time when the image forming apparatus detects that the recording paper sheet is left in the paper discharge tray, and a user ID for identifying a user who leaves the recording paper sheet in the tray as the leaving information, and the leaving information count portion counts the number of print jobs associated with the detection of the recording paper sheets left in the tray for every image forming apparatus based on the leaving detection time and the user ID.

Another object of the present invention is to provide the print managing apparatus, wherein the leaving information acquiring portion acquires a leaving detection time, which is a time when the image forming apparatus detects that the recording paper sheet is left in the paper discharge tray, and a user ID for identifying a user who leaves the recording paper sheet in the tray as the leaving information, and the leaving information count portion counts the number of print jobs associated with detection of the recording paper sheets left in the tray for a predetermined time or longer after the recording paper sheet is left for every image forming apparatus based on the leaving detection time and the user ID.

Another object of the present invention is to provide the print managing apparatus that comprises a warning portion that transmits warning information for prompting a user not to leave a recording paper sheet in a paper discharge tray and transmits the warning information to a terminal apparatus of a user having the number counted by the leaving information count portion equal to or greater than a predetermined number, when receiving a print job from the terminal apparatus of the user.

Another object of the present invention is to provide the print managing apparatus, wherein the warning portion transmits the warning information to a terminal apparatus of a user having the number counted by the leaving information count portion for specified time zone equal to or greater than a predetermined number, if the time when the apparatus received a print job from the terminal apparatus of the user is in the specified time zone.

Another object of the present invention is to provide the print managing apparatus, wherein the warning portion transmits the warning information to a terminal apparatus of a user having the number of specified image forming apparatuses counted by the leaving information count portion equal to or greater than a predetermined number, if an output destination designated by a print job from the terminal apparatus of the user is any of the specified image forming apparatuses.

Another object of the present invention is to provide the print managing apparatus, wherein if a print job accepted by an image forming apparatus includes information indicating that the print job is important, the leaving information count portion counts only the leaving information including the information indicating the importance for every user.

Another object of the present invention is to provide the print managing apparatus, wherein if a print job accepted by an image forming apparatus includes information indicating that the print job is important, the leaving information count portion separately counts the leaving information including the information indicating the importance and other pieces of the leaving information for every user.

Another object of the present invention is to provide the print managing apparatus that comprises a warning portion that transmits warning information for prompting a user not to leave a recording paper sheet in a paper discharge tray and transmits the warning information to a terminal apparatus of a user having the number counted by the leaving information count portion equal to or greater than a predetermined number, if the print job from the terminal apparatus of the user includes the information indicating the importance.

Another object of the present invention is to provide the print managing apparatus that comprises a warning portion that transmits warning information for prompting a user not to leave a recording paper sheet in a paper discharge tray and transmits the warning information to a terminal apparatus of a user having the counted number of the leaving information including the information indicating the importance equal to or greater than a predetermined number as the counted result by the leaving information count portion, if the print job from the terminal apparatus of the user includes the information indicating the importance.

Another object of the present invention is to provide a print managing system comprising the print managing apparatus, a terminal apparatus that transmits a print job, and an image forming apparatus having a leaving detecting portion to detect that a recording paper sheet discharged/stacked in a paper discharge tray is left in the tray, wherein the print managing apparatus, the terminal apparatus, and the image forming apparatus are connected each other through a network, the image forming apparatus transmits to the print managing apparatus a job number of the print job, a user ID, and an identification number of the image forming apparatus when receiving a print job from the terminal apparatus, and the image forming apparatus transmits to the print managing apparatus a job number of the print job and the identification number of the image forming apparatus that are associated with the detection of the leaving when the image forming apparatus detects that a recording paper sheet is left in the tray.

Another object of the present invention is to provide a program for implementing the function of the print managing apparatus.

BRIEF DESCRIPTION OF THE DRAWINGS

FIGS. 8A and 8B are explanatory views of an example of a method of creating/updating a leaving history table of the management server;

FIGS. 9A to 9D are explanatory views of another example of a method of creating/updating the leaving history table of the management server;

FIG. 10 depicts an example of a leaving count table created and updated by the management server;

FIGS. 19A and 19B are explanatory views of another example of a method of creating/updating the leaving history table of the management server;

FIGS. 20A and 20B are explanatory views of another example of the leaving count table created/updated by the management server;

PREFERRED EMBODIMENTS OF THE INVENTION

Preferred embodiments of a print managing apparatus, a print managing system, and a program will be described with reference to the accompanying drawings.

Figure 1:
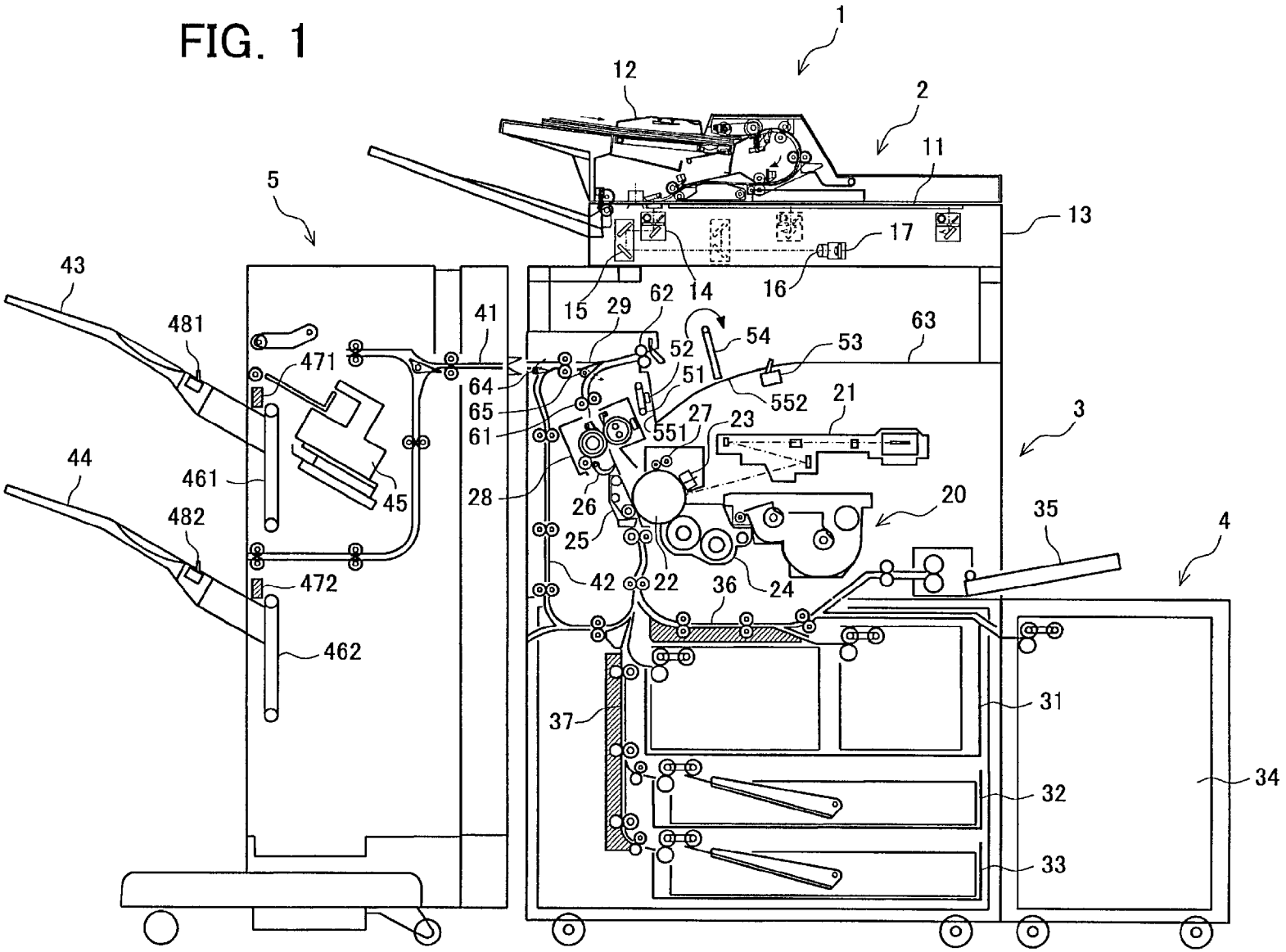
FIG. 1 is a cross-section view of an example of a principal part of the configuration of an image forming apparatus including a leaving detection function applicable to a print managing system of the present invention.

FIG. 1 is a cross-section view of an example of a principal part of the configuration of an image forming apparatus including a leaving detection function applicable to a print managing system of the present invention, and 1 indicates an image forming apparatus including a leaving detection function (hereinafter, simply an image forming apparatus) in FIG. 1. The image forming apparatus 1 is mainly composed of an image reading portion 2, an image forming portion 3, a paper feeding portion 4, and a post-processing apparatus 5.

As shown in FIG. 1, the image reading portion 2 is composed of a document platform 11 made of clear glass, a reversing automatic document feeder (RADF) 12 for automatically supplying a document onto the document platform 11, and a document image reading unit, or a scanner unit 13 for scanning and reading an image of a document placed on the document platform 11.

The RADF 12 is a known apparatus which automatically feeds documents set in a predetermined document tray one-by-one onto the document platform 11 of the scanner unit 13. The RADF 12 is composed of a conveying path for one-side documents, a conveying path for two-side documents, a conveying path switching portion, etc., so that the scanner unit 13 reads one side or both sides of the document according to a user's selection.

The scanner unit 13 is configured by a lamp reflector assembly that exposes a document surface, a first scanning unit 14 equipped with a first reflecting mirror for guiding a reflected light image from a document to a Charge Coupled Device (CCD) 17 for conversion into electric image signals; a second scanning unit 15 equipped with second and third reflecting mirrors, and an optical lens body 16 for focusing the reflected light image on the CCD 17. Scanning control is executed such that the first scanning unit 14 travels from left to right along the document platform 11 at a constant velocity V and that the second scanning unit 15 travels in the same direction at a velocity of V/2.

As a result, with associated operations of the RADF 12 and the scanner unit 13, the image reading portion 2 sequentially places documents to be read on the document platform 11, moves the scanner unit 13 along the undersurface of the document platform 11, and sequentially focuses onto the CCD 17 each line of an image of the document placed on the document platform 11 to read the document image.

The image data acquired by reading the document image with the scanner unit 13 are subjected to various processes and temporarily stored in a memory not shown, and after the image data are output from the memory to the image forming portion 3 in response to an output instruction and are reproduced as a visible image on a photoconductor drum 22, the image is transferred onto a paper sheet to form a toner image.

The image forming portion 3 includes a laser scanning unit (LSU) 21 and an electrophotographic process portion 20 for forming an image. The laser scanning unit 21 includes a semiconductor laser that emits a laser beam depending on the image data read from the memory or image data transferred from an external device such as a personal computer, a polygon mirror that deflects the laser beam at a constant angular velocity, an f-θ lens that corrects the laser beam deflected at the constant angular velocity such that the photoconductor drum 22 of the electrophotographic process portion 20 is scanned at a constant velocity.

The electrophotographic process portion 20 includes a charging apparatus 23, a developing apparatus 24, a transferring apparatus 25, a peeling apparatus 26, a cleaning apparatus 27, and an neutralizatin apparatus arranged around the photoconductor drum 22 in accordance with a known aspect and also includes a fixing apparatus 28 disposed downstream of the photoconductor drum 22.

The paper feeding portion 4 includes first to third cassettes 31 to 33 and a manual feed tray 35. The first cassette 31 is a tandem tray housing first and second trays and enables the both trays to be pulled out from the apparatus main body at the same time. The second cassette 32 and the third cassette 33 house a third tray and a fourth tray, respectively. That is, the three cassettes (31 to 33) house the four trays. Paper conveying portions 36 and 37 include paper feed rollers, conveying rollers, and resist rollers for conveying paper sheets from the paper feeding portion 4 to a transfer position between the photoconductor drum 22 and the transferring apparatus 25.

Paper sheets are stacked and housed in the four trays within the first to third cassettes 31 to 33 in the paper feeding portion 4 in accordance with the sizes of the paper sheets, and if a user selects a cassette or tray housing the paper sheets of the size desired by the user, the paper sheets are sent out one-by-one from the top of the sheet stack in the tray and are sequentially conveyed through the conveying paths of the paper conveying portions 36 and 37 to the electrophotographic process portion 20.

A paper sheet discharge path 29 is disposed on the downstream side in the paper sheet conveying direction from the fixing apparatus 28, and the paper sheet discharge path 29 is branched into a paper sheet conveying path 41 of the post-processing apparatus 5 and a paper re-conveying portion 42 for both sides copying.

In the laser scanning unit 21 and the electrophotographic process portion 20, the image data read from the memory are formed as an electrostatic latent image on the surface of the photoconductor drum 22 by scanning a laser beam with the laser scanning unit 21; the electrostatic latent image is turned into a visible image, i.e., a toner image by the toner of the developing apparatus 24; and the toner image is transferred onto a surface of a sheet conveyed by the paper feeding portion 4 through electrostatic image transfer by the transferring apparatus 25 and is fixed by the fixing apparatus 28.

The paper sheet having the image formed thereon is sent from the fixing apparatus 28 to the post-processing apparatus 5 or is selectively conveyed to the paper re-conveying portion 42 for both sides copying. The paper sheet sent to the post-processing apparatus 5 is subjected to a predetermined process such as a sort or staple process if necessary, and is stacked in a first discharge tray 43 or a second discharge tray 44. The paper sheet sent to the paper re-conveying portion 42 for both sides copying is reversed and conveyed to the electrophotographic process portion 20 again, and an image is formed on the backside of the paper sheet, which is discharged after the image is fixed.

The image forming apparatus 1 shown in FIG. 1 includes the first to third cassettes 31 to 33 and the manual feed tray 35 in the apparatus main body, and a high-capacity cassette 34 is added as an optional fifth tray. An upwardly biased elevator is included within the high-capacity cassette 34; paper sheets are accumulated in this elevator; a top paper sheet is in contact with a paper feed roller; and the paper sheet is isolated and sent out by rotating the paper feed roller and enters into the paper conveying portion 36 of the apparatus main body. The high-capacity cassette 34 has a high-capacity tray and, therefore, can store standard paper sheets of the most frequently used size, for example, A4 size.

The post-processing apparatus 5 is disposed to the left of the image forming system and includes the first discharge tray 43 and the second discharge tray 44. The second discharge tray 44 is a discharging portion that receives sheets having images formed thereon discharged from the image forming portion 3 through a discharged/received paper conveying path 41 provided at an upper side of the post-processing apparatus 5 to discharge the sheets as it is. The first discharge tray 43 is a discharging portion that discharges sheets subjected to a post-process by a post-processing portion 45 mounted selectively, such as a staple and a punch. The post-processing apparatus 5 is configured such that the sheets having images formed thereon are discharged from the first discharge tray 43 or the second discharge tray 44 selected by a user.

The image forming apparatus 1 supports the two-side printing and a configuration for the two-side printing will hereinafter be described.

A sheet having an image recorded thereon is conveyed through the fixing apparatus 28 and upwardly by a conveying roller 61 and passes through a switch gate 65. If a discharge tray of the sheet is set as a stack tray 63 included in an outer cover of the image forming portion 3, the sheet is discharged into the stack tray 63 by a reverse roller 62. On the other hand, if the two-side image formation or post-process is specified, the sheet is once discharged toward the stack tray 63 by the reverse roller 62. In this case, the sheet is not completely discharged and the reverse roller 62 is reversed while the sheet is kept pinched. The sheet is then reversed and conveyed in the opposite direction, i.e., a direction toward the paper re-conveying portion 42 and the post-processing apparatus 5 selectively mounted for the two-side image formation and post-process.

In this case, the switch gate 65 is switched from a state of the solid line shown (upward) to a state of the broken line (downward). If the two-side image formation is performed, the reversely conveyed sheet passes through the paper re-conveying portion 42 while another switch gate 64 is in the upward (broken line) state and is supplied to the image forming portion 3 again. On the other hand, the post-process is executed, the sheet is conveyed from the paper re-conveying portion 42 to the post-processing apparatus 5 while the another switch gate 64 is in the downward (solid line) state to execute the post-process.

The image forming apparatus 1 of the embodiment achieves with a simple apparatus configuration a function of synthetically printing an ID image specific to a user on a recording paper sheet and reading the ID image to notify the user of a recording paper sheet (print) forgotten to be taken out without including a special recording paper conveying portion and can change a print surface and location of the ID image depending on output conditions of recording paper sheets. Therefore, the image forming apparatus 1 includes the image forming portion 3 that synthetically prints image data and ID image data specific to a user on a recording paper sheet, the stack tray (hereinafter, paper discharge tray) 63 that is a paper discharging portion for discharging and accumulating the recording paper sheets having the image data and the ID image data synthetically printed thereon, an ID image reading portion 52 that reads the ID images on the recording paper sheets accumulated in the paper discharge tray 63, an elevating portion 51 configured by a driving roller (motor) and a belt for moving up and down the ID image reading portion 52, a recording paper sensor 53 that detects the presence of the recording paper sheets in the paper discharge tray 63, and an aligning portion (paddler) 54 that aligns the edges of the recording paper sheets such that the edges are shifted from each other.

The ID image reading portion 52 is a line sensor or an area sensor configured by a CCD that is an image pickup device, and is disposed on a position where the ID image can be read at the edges of the recording paper sheets discharged in the paper discharge tray 63.

The paper discharge tray 63 is provided with a transparent alignment surface 551 contacted with the edges of each recording paper sheet such that the ID images at the recording paper sheet edges can be read out by the ID image reading portion 52 and a recording paper stack surface 552 that is slanted relative to the alignment surface 551. Since the recording paper stack surface 552 is downwardly slanted toward the alignment surface 551, each recording paper sheet is slanted relative to the alignment surface 551, and the edges of each recording paper sheet is aligned such that the edges are shifted from each other by the aligning portion 54. This configuration enables the paper discharge tray 63 to accumulate the recording paper sheets with the ID images revealed at the edges of each recording paper sheet, and the ID image reading portion 52 can accurately detect the ID images of each recording paper sheet.

When a print request is accepted from a user, the image forming portion 3 prints image data on a recording paper sheet and prints ID image data at the edge of the recording paper sheet and discharges and accumulates the print in the paper discharge tray 63. While the recording paper sheets are accumulated in the paper discharge tray 63 and the edges of the recording paper sheets contacts with the alignment surface 551, the ID image reading portion 52 reads the ID images at the edges of the recording paper sheets through the alignment surface 551. The ID image data are preliminarily registered in a memory not shown for each user and, for example, if a print request is sent from a PC used by a user, the memory is referenced from user information included in the print request to identify the ID image data corresponding to the user information.

The image forming apparatus 1 includes a communication function such as e-mail to notify an external device specified by a user corresponding to the ID image read by the ID image reading portion 52 that the recording paper sheets in the paper discharge tray 63 must be removed. The user notification may be performed at such timing when a predetermined time has elapsed after the recording paper sheets are discharged. The external device may be not only a PC but also a portable terminal such as a portable telephone used by the user, and the e-mail address of the external device specified by the user is preliminarily registered and correlated with the ID image data in the image forming apparatus 1. A unique IP address of the external device may be specified for direct notification. In this case, the IP address may be registered and correlated with the ID image data.

The discharge destination of recording paper sheets may be the first discharge tray 43 or the second discharge tray 44 included in the post-processing apparatus 5 instead of the paper discharge tray 63. The first discharge tray 43 includes a tray elevating portion 461 configured by a driving roller (motor) and a belt for moving up and down the first discharge tray 43, an ID image reading portion 471 configured by a CCD (line sensor or an area sensor) reading the ID images of the recording paper sheets accumulated in the first discharge tray 43, and a recording paper sensor 481 that detects the presence of the recording paper sheets on the paper discharge tray 43. Similarly, the second discharge tray 44 includes a tray elevating portion 462, an ID image reading portion 472, and a recording paper sensor 482. Although the ID image reading portion is moved up and down to read the ID images of the recording paper sheets in the case of the paper discharge tray 63, the ID image reading portion is fixed and the tray is moved up and down to read the ID images of the recording paper sheets in the case of the first discharge tray 43 or the second discharge tray 44.

The image forming apparatus 1 of the embodiment is not limited to the form of moving up and down the ID image reading portion to read the ID images and may be the form of fixing the ID image reading portion and moving up and down the paper discharge tray to read the ID images.

Figure 2:
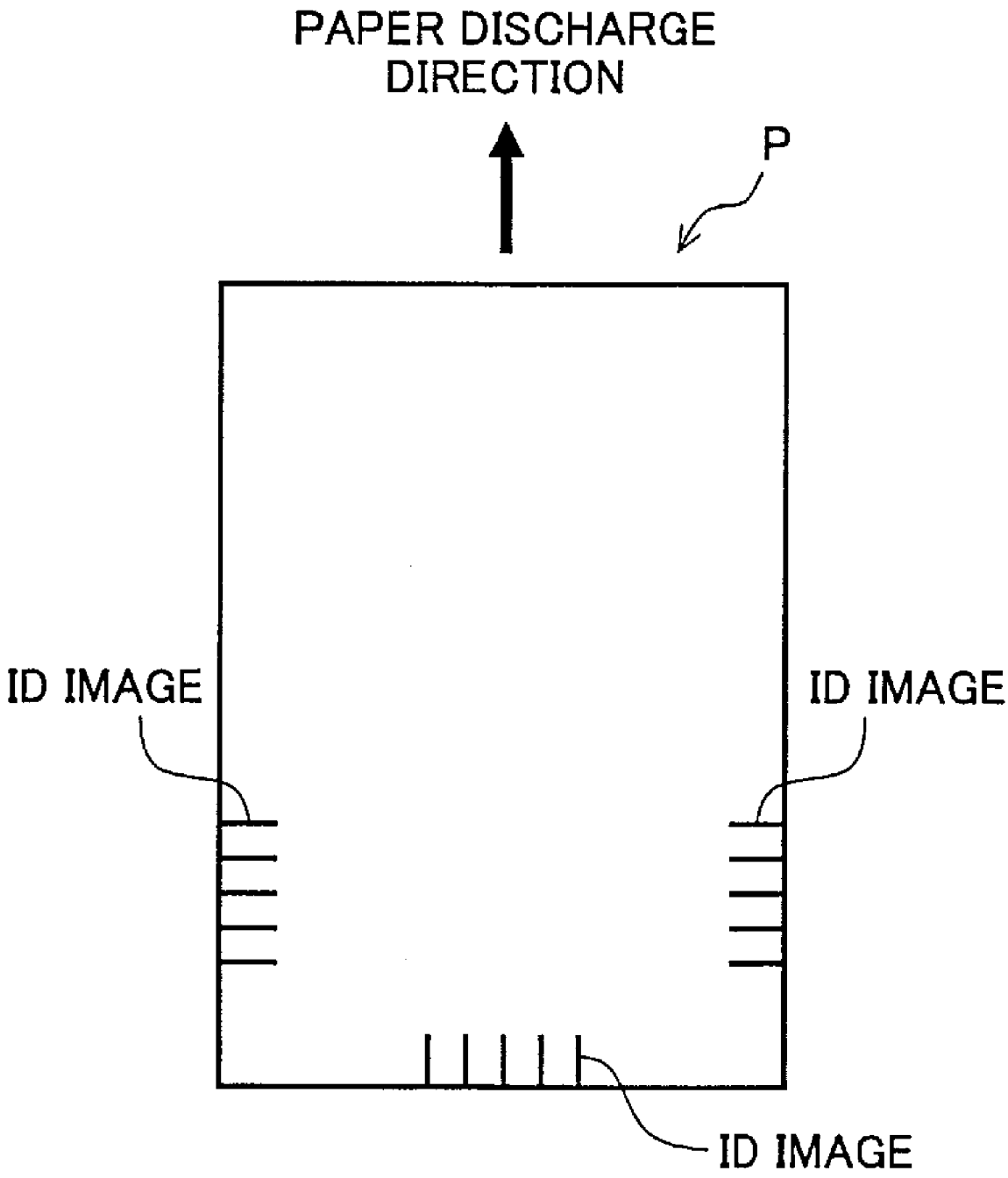
FIG. 2 depicts an example of an ID image printed on a recording paper sheet.

FIG. 2 depicts an example of an ID image printed on a recording paper sheet, and P indicates a recording paper sheet in FIG. 2. On the recording paper sheet P, the ID image is synthetically printed at any one of the edges of three sides except the leading edge toward the paper discharge direction (recording paper sheet conveying direction) shown by an arrow of FIG. 2. The ID image synthetically formed at the leading edge of a recording paper sheet is not preferable since winding at the time of fixing is likely to occur. Therefore, it is desirable to avoid the leading edge and synthetically print the ID image at the edges of three sides other than the leading edge. The ID image is, for example, a barcode indicating identification information specific to a user and this identifies a user who executes printing.

Figure 3A:
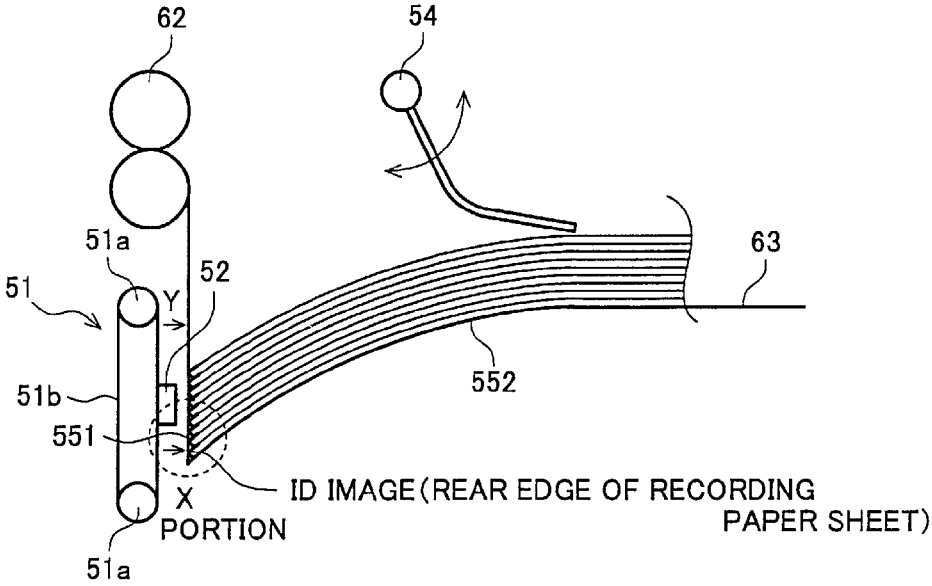
FIGS. 3A to 3C depict a peripheral configuration example of an ID image reading portion included in the image forming apparatus according to the present invention.
Figure 3B:
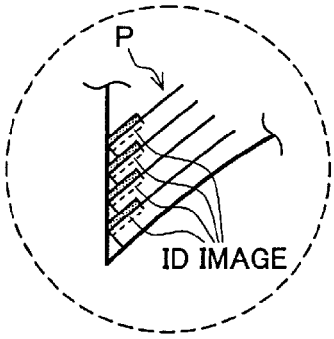
Figure 3C:
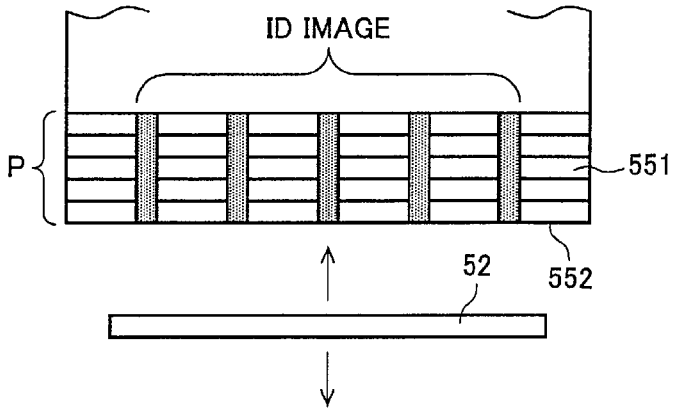

FIGS. 3A to 3C depict a peripheral exemplary configuration of the ID image reading portion 52 included in the image forming apparatus 1 according to one embodiment of the present invention. FIG. 3A is a side view of a peripheral configuration of the ID image reading portion 52; FIG. 3B is an enlarged view of an X portion shown in FIG. 3A; and FIG. 3C is a diagrammatic view of a rear edge cross-section of the recording paper sheets P when an alignment surface shown in FIG. 3A is viewed from the Y direction.

In FIG. 3A, a plurality of the recording paper sheets P is discharged and accumulated in the paper discharge tray 63 and an ID image is printed at the rear edge of each recording paper sheet P in the recording paper sheet conveying direction. The rear edges of the recording paper sheets P contact with the alignment surface 551, and the ID image reading portion 52 is moved up and down by the elevating portion 51 to read the ID images printed at the rear edges of the recording paper sheets P with the ID image reading portion 52. The elevating portion 51 is configured by a drive system 51*a* consisting of a driving roller (motor) and a driven roller and a belt 51*b* that is a power transmitting portion between the both rollers and moves up and down the ID image reading portion 52 to a position where the ID images can be read.

As shown in FIG. 3B, although a barcode is printed as the ID image at the rear edge of the recording paper sheet, the print portion of the barcode has a thickness greater than that of the recording paper sheet P by toner and some amount of toner infiltrates into the recording paper sheet P. While a plurality of the recording paper sheets P is stacked, since the barcode portions overlap in the rear edge cross-section as shown in FIG. 3C to make the barcode portions black and other portions white, the rear edge cross-section has color densities (contrast). Therefore, the barcodes can accurately be read by scanning the rear edge cross-section with the ID image reading portion 52.

As shown in FIG. 3C, if a plurality of the recording paper sheets P of the same user is accumulated in the paper discharge tray 63, the ID images printed at the same position of the rear edges overlap at substantially the same position. Therefore, as the number of the recording paper sheets P increases, the contrast of the ID images becomes sharper at the rear edge cross-section, and the reading accuracy of the ID image reading portion 52 is improved. Although the print surface of the ID image may be one side or two sides of the recording paper sheet P, since the print portion of the ID image becomes thicker than the one-side case when the ID image is printed on two sides, the ID images can be read from a smaller number of sheets than the one-side case and it becomes easier than the one-side case to read the ID images from the same number of sheets.

Figure 4:
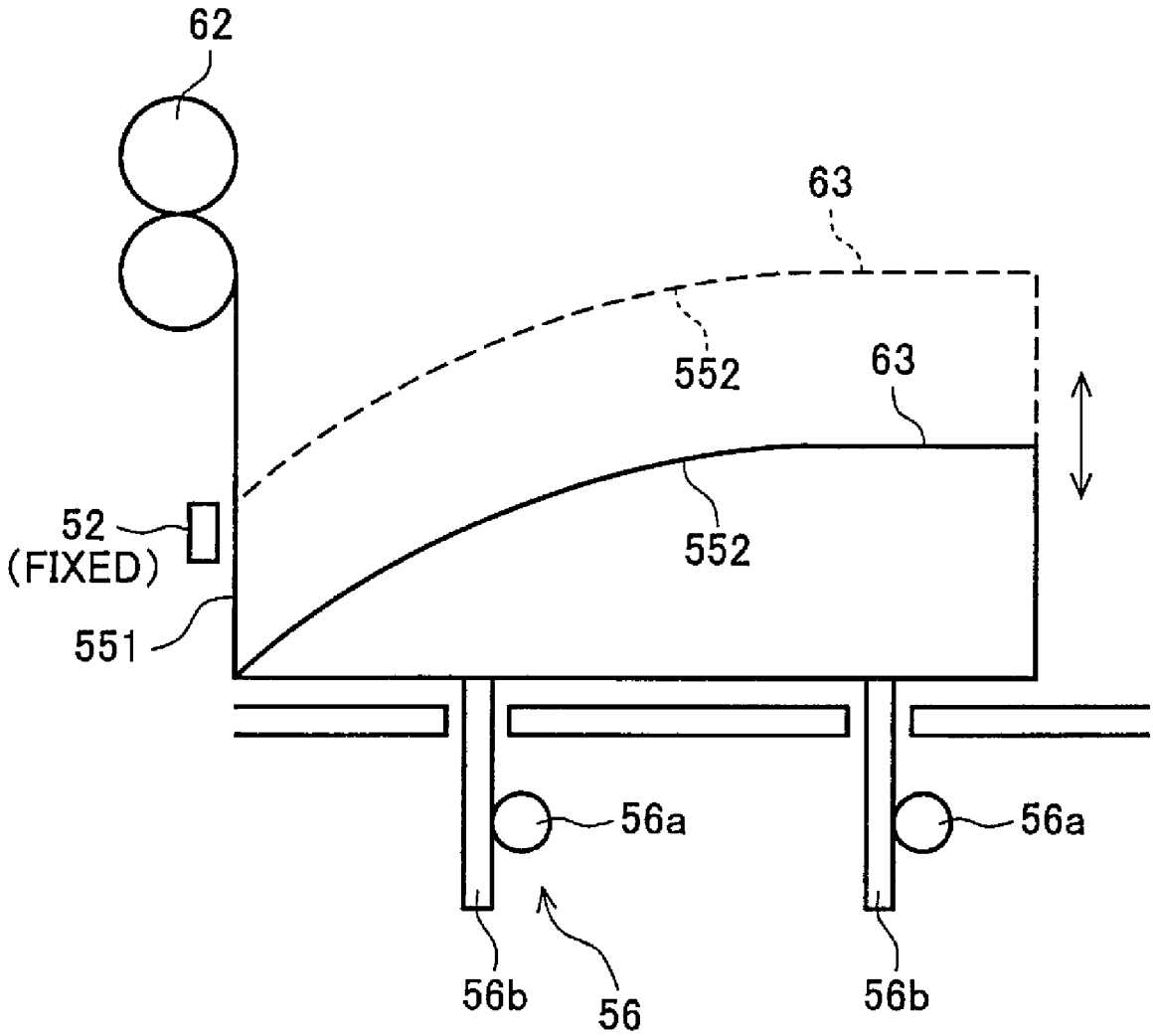
FIG. 4 depicts a peripheral configuration of the ID image reading portion different from those shown in FIGS. 3A to 3C.

FIG. 4 depicts an example of a peripheral configuration of the ID image reading portion 52 which is different from those shown in FIGS. 3A to 3C. Instead of the elevating portion 51, the image forming apparatus 1 includes a tray elevating portion 56 that moves up and down the paper discharge tray 63. While the ID image reading portion 52 is fixed, the tray elevating portion 56 moves up and down the paper discharge tray 63 to read the ID images at the rear edges of the recording paper sheets. The tray elevating portion 56 is configured by a driving roller 56*a* and a support member 56*b* supporting the paper discharge tray 63 and moved up and down by the driving roller 56*a*, and the paper discharge tray 63 is moved up and down to a position where the ID images can be read.

Figure 5A:
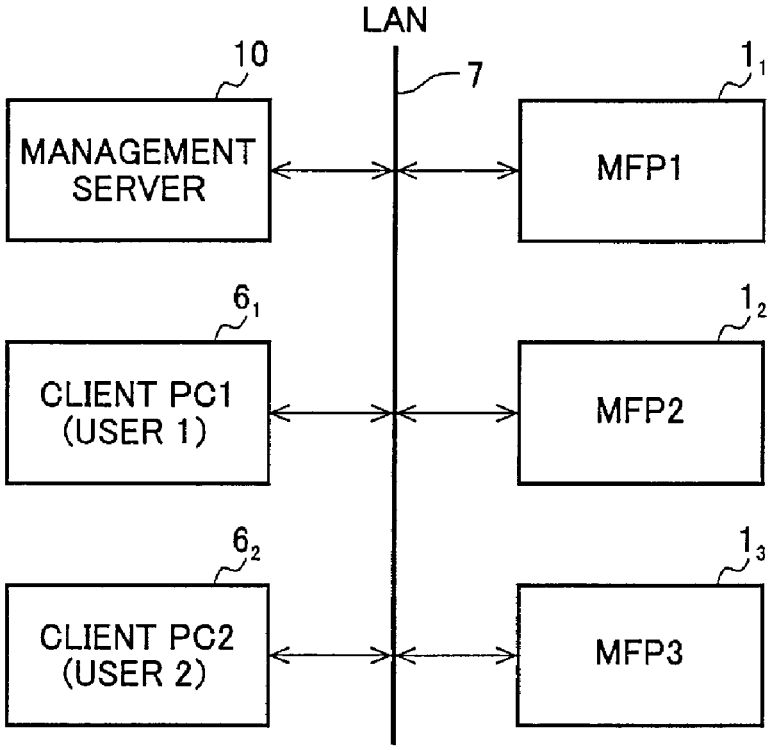
FIGS. 5A to 5C depict a configuration example of a print managing system according to one embodiment of the present invention.
Figure 5B:
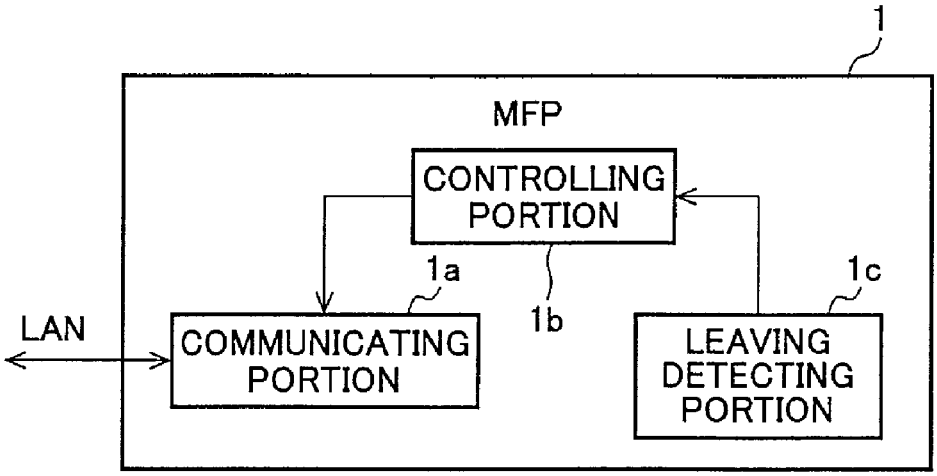
Figure 5C:
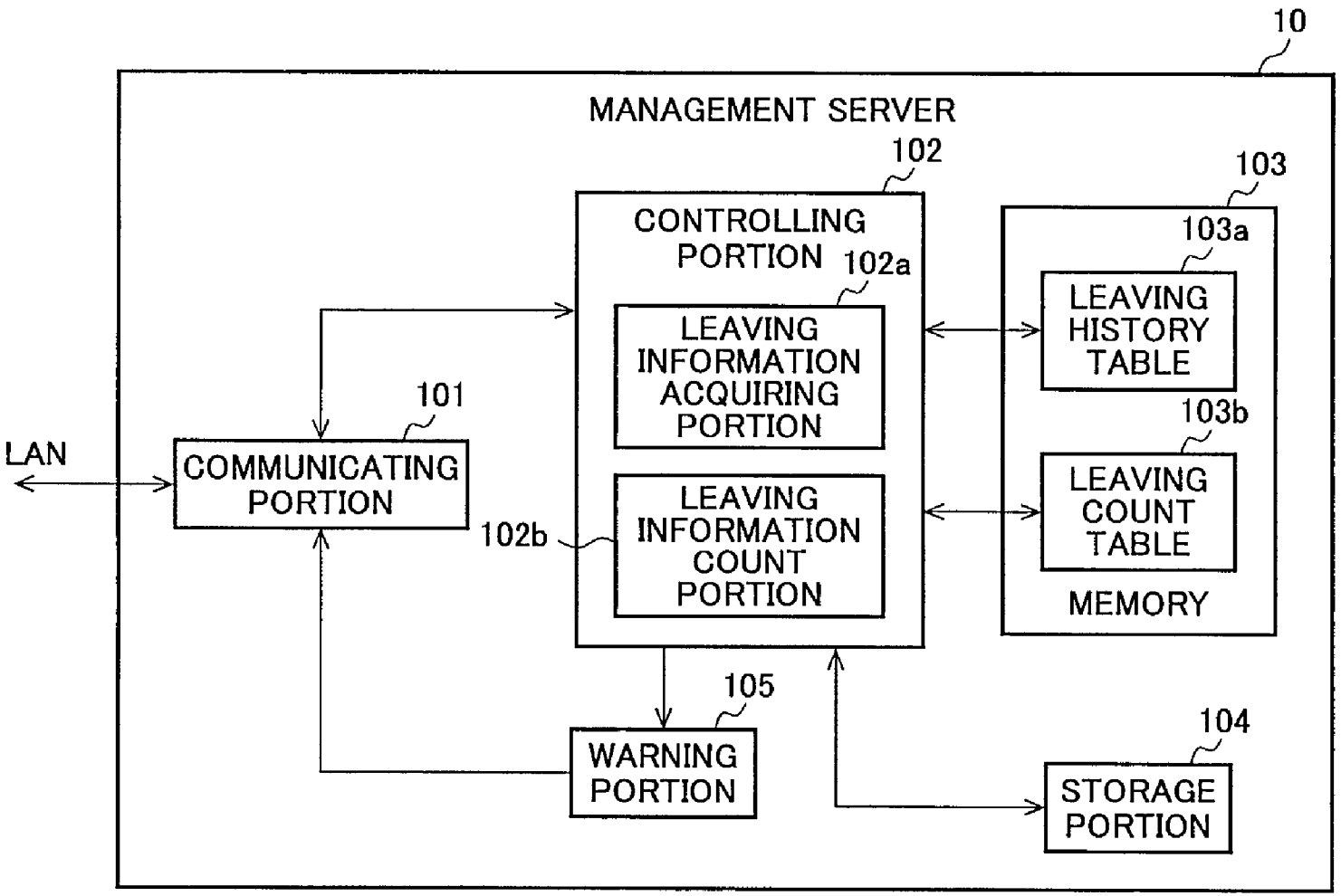

FIGS. 5A to 5C depict a configuration example of a print managing system according to one embodiment of the present invention. FIG. 5A depicts an example of a connection configuration of the print managing system according to the embodiment. In FIG. 5A, $\mathbf{1}_1$ to $\mathbf{1}_3$ denote MFPs (digital multi-function peripherals) that are the image forming apparatuses; $\mathbf{6}_1$ and $\mathbf{6}_2$ denote client PCs that are the terminal apparatuses; 10 denotes a management server; and 7 denotes a network such as LAN. The management server 10, the MFPs $\mathbf{1}_1$ to $\mathbf{1}_3$, and the client PCs $\mathbf{6}_1$ and $\mathbf{6}_2$ are connected through the LAN 7. In this embodiment, the three MFPs $\mathbf{1}_1$ to $\mathbf{1}_3$ are MFPs including the leaving detection function, which are the image forming apparatuses shown in FIG. 1 above.

The client PC $\mathbf{6}_1$ or client PC $\mathbf{6}_2$ has a built-in printer driver and generates and transmits to the LAN 7 a print job for driving any MFP to print document data or image data in accordance with user's operation. This print job includes information such as a user ID, identification information (such as an IP address) of the client PC, MFP as an output destination, and various print settings, along with print data to be printed and output.

FIG. 5B is a block diagram of a configuration example of the MFP including the leaving detection function. In FIG. 5B, an MFP 1 includes a communicating portion 1*a* for communicably connecting to the management server 10 and the client PC 6 through the LAN 7, a controlling portion 1*b* including a CPU for controlling the operation of the apparatus and a ROM, a RAM, etc., and a leaving detecting portion 1*c* that detects that a recording paper sheet discharged/stacked in the paper discharge tray is left unremoved. The leaving detecting portion 1*c* is implemented by the leaving detection function shown in FIG. 1 above.

FIG. 5C is a block diagram of a configuration example of the management server 10. In FIG. 5C, the management server 10 includes a communicating portion 101 for communicably connected to the MFP 1 and the client PC 6 through the LAN 7, a controlling portion 102 including a CPU for controlling the operation of the apparatus and a RAM, etc., a memory 103 that stores a leaving history table 103*a* and a leaving count table 103*b*, a storage portion 104 such as a hard disc, and a warning portion 105 that transmits through the communicating portion 101 the warning information for prompting a user not to leave a recording paper sheet in a paper discharge tray.

The controlling portion 102 includes a leaving information acquiring portion 102*a* and a leaving information count portion 102*b* which are programs for performing the function as the management server 10 of the present invention. The leaving information acquiring portion 102*a* and the leaving information count portion 102*b* are stored in the storage portion 104 or the memory 103 and are read onto the RAM of the controlling portion 102 and executed by the CPU at the time of execution.

The leaving information acquiring portion 102*a* acquires the leaving information related to the recording paper sheets left in the tray for each print job accepted by the MFP 1. The leaving information count portion 102*b* counts the leaving information for each user. The leaving information includes, for example, a time when the MFP 1 (leaving detecting portion 1*c*) detects that a recording paper sheet is left unremoved (a leaving detection time), a user ID for identifying a user, a unique job number of a print job, a unique MFP number of the MFP for each print job.

The leaving information count portion 102*b* creates/updates the leaving history table 103*a* based on the leaving information acquired by the leaving information acquiring portion 102*a* and creates the leaving count table 103*b* with reference to the leaving history table 103*a*. The controlling portion 102 identifies a user who frequently leaves sheets in a paper discharge tray (a habitual leaving user) based on a predetermined condition with reference to the leaving count table 103*b*. Each time the user (habitual leaving user) executes a print job from the client PC 6, the warning portion 105 transmits the warning information to the client PC 6 for preliminary notification preventing a recording paper sheet from being left unremoved, based on the control of the controlling portion 102.

Figure 6:
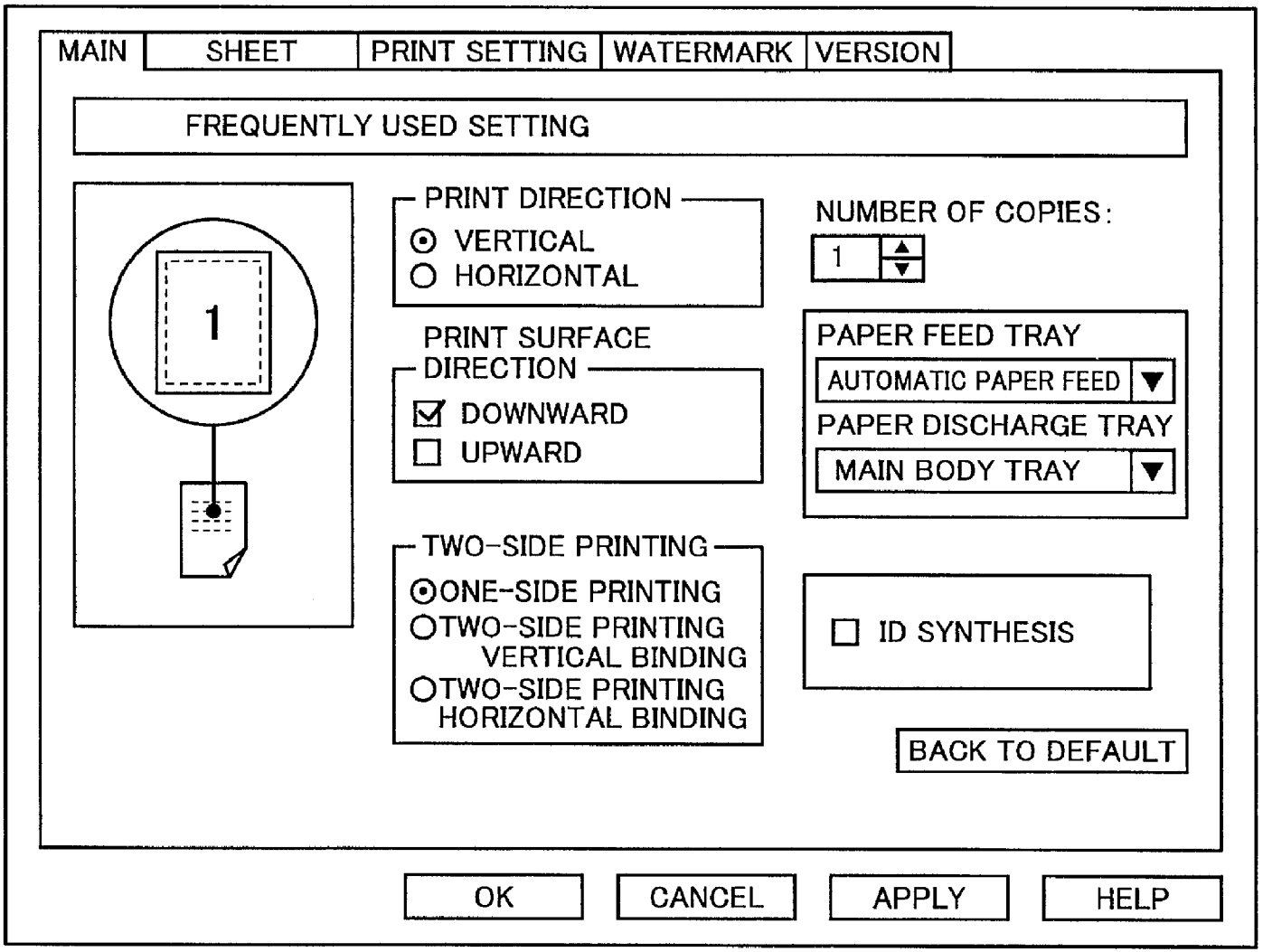
FIG. 6 depicts an example of a printer driver setting screen displayed on a client PC.

FIG. 6 depicts an example of a printer driver setting screen displayed on the client PC. When printing document data, a user operates the client PC 6 to display the printer driver setting screen and performs various print settings on this setting screen. The setting information set here is transmitted along with a print job. For example, if "ID composition" is checked, the leaving detection function of the MFP 1 is enabled to detect that the recording papers discharged/stacked in the paper discharge tray are left unremoved.

Figure 7:
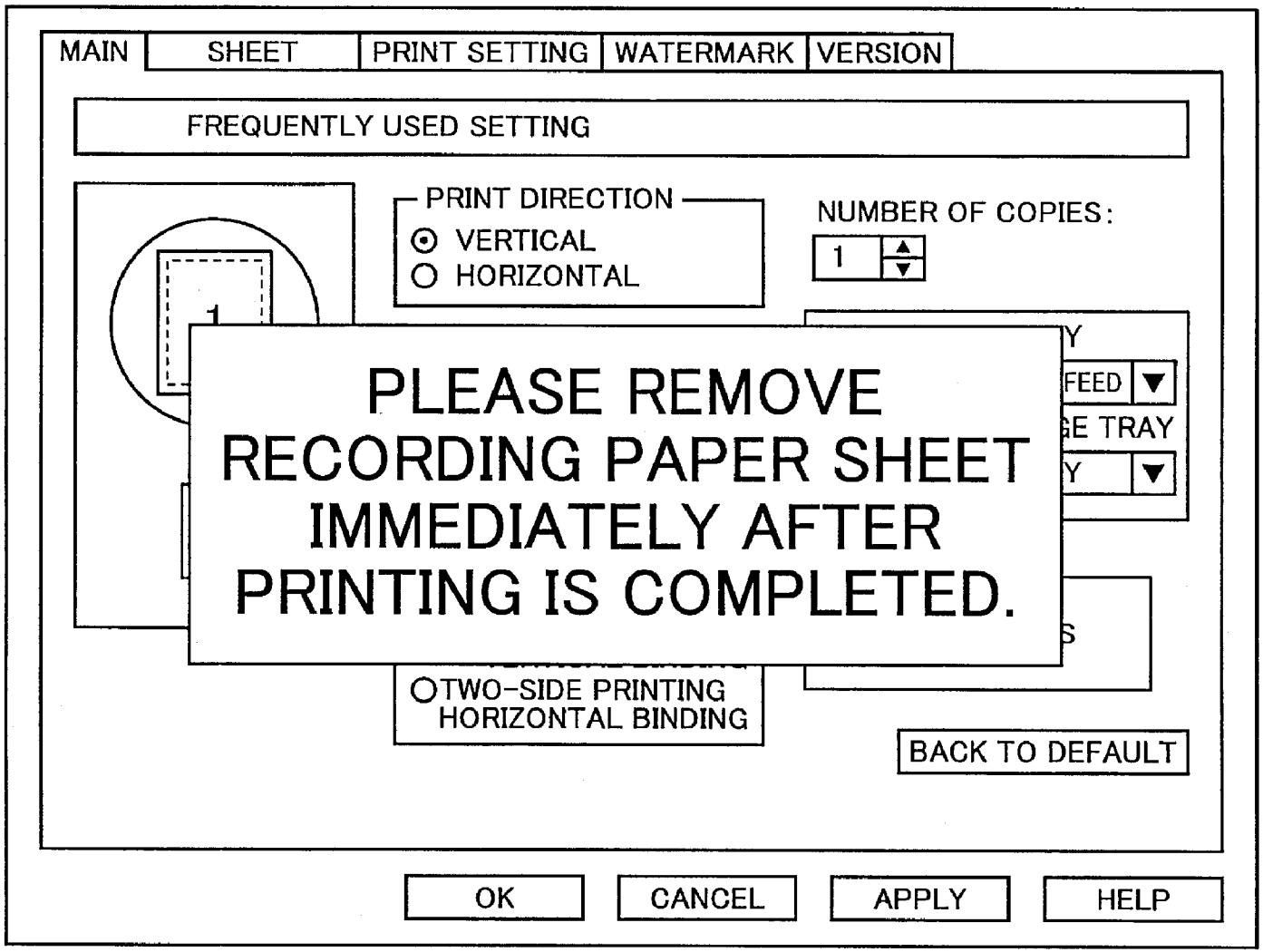
FIG. 7 depicts an example of warning information transmitted from a warning portion of a management server and displayed on a screen of the client PC.

FIG. 7 depicts an example of the warning information transmitted from the warning portion 105 of the management server 10 and displayed on the screen of the client PC. As described above, for the user determined as the habitual leaving user by the management server 10, each time the user executes a print job, a warning message shown is displayed for notification preventing the user from leaving a recording paper sheet in the paper discharge tray.

Since the leaving situations can be counted from the leaving history of each user and a warning notification can be sent to a user who frequently forgot paper sheets in the past based on the counted result, when accepting a print job, the leaving itself can be prevented.

FIGS. 8A and 8B are explanatory views of an example of a method of creating/updating the leaving history table 103*a* of the management server 10. The creating/updating processing of the leaving history table 103*a* shown in this example is executed by the leaving information count portion 102*b* included in the management server 10.

In FIG. 8A, when a print job is executed by the client PC 6, the MFP 1 or the MFP 2 accepted the print job transmits to the management server 10 the job information such as a job number, a user ID, and an MFP number. The management server 10 registers the job information such as the job number, the user ID, and the MFP number into the leaving history table 103*a*. Although this job information is included in the leaving information of the present invention, each MFP transmits a job number, a user ID, and an MFP number to the management server 10 at the time of the registration, and each MFP transmits a job number and an MFP number to the management server 10 at the time of the leaving detection described later.

In this example, items of the leaving history table 103*a* are a job number, a user ID, an MFP number, a time T1 when the presence of a recording paper sheet is initially detected, and a leaving time excess flag and are created/updated based on the job information from the MFP 1 or the MFP 2. In this example, "JOB1, C12345, MFP1" and "JOB2, C54321, MFP2" are registered in order of the job number, the user ID, and the MFP number. This registration processing is performed each time when a print job is executed.

After outputting the print jobs accepted by the MFPs, each MFP detects regularly or at arbitrary timing using the leaving detecting portion whether the recording paper sheets discharged/stacked in the paper discharge tray are left unremoved. For example, if the MFP 1 detects that the recording paper sheets of the JOB1 are left unremoved, the leaving information of the JOB1 (the job number and the MFP number in this case) is transmitted to the management server 10, and a reception time of the information at the management server 10 (12:10 in this case) is registered into the leaving history table 103*a*. Only the leaving information of the JOB1 for which the recording paper sheets left unremoved in the paper discharge tray is transmitted, and the leaving information of the JOB2 is not transmitted since the leaving is not detected.

As shown in FIG. 8B, the time T1 of the leaving history table 103*a* is updated to "12:10" and the leaving time excess flag is updated to "exceeded". As above, when it is detected that the recording paper sheet is left in the tray, it is immediately determined that the leaving time is over and this is recorded in the leaving history table 103*a* in this example.

FIGS. 9A to 9D are explanatory views of another example of a method of creating/updating the leaving history table 103 of the management server 10. The creating/updating processing of the leaving history table 103*a* shown in this example is executed by the leaving information count portion 102*b* included in the management server 10.

In FIG. 9A, when a print job is executed by the client PC 6, the MFP 1 or the MFP 2 accepted the print job transmits to the management server 10 the job information such as a job number, a user ID, and an MFP number. The management server 10 registers the job information such as the job number, the user ID, and the MFP number in the leaving history table 103*a*.

In this example, items of the leaving history table 103*a* are a job number, a user ID, an MFP number, a time T1 when the presence of a recording paper sheet is initially detected, a time T2 when the presence of a recording paper sheet is lastly detected, a leaving time (T2−T1), and a leaving time excess flag ("exceed" if the leaving time is 20 minutes or longer) and are created/updated based on the job information from the MFP 1 or the MFP 2. In this example, "JOB1, C12345, MFP1" and "JOB2, C54321, MFP2" are registered in order of the job number, the user ID, and the MFP number. This registration processing is performed each time when a print job is executed.

After outputting the print jobs accepted by the MFPs, each MFP detects regularly or at arbitrary timing using the leaving detecting portion whether the recording paper sheets discharged/stacked in the paper discharge tray are left unremoved. For example, if the MFP 1 detects that the recording paper sheets of the JOB1 are left unremoved, the leaving information of the JOB1 (the job number and the MFP number in this case) is transmitted to the management server 10, and a reception time of the information at the management server 10 (12:10 in this case) is registered in the leaving history table 103*a*. That is, as shown in FIG. 9B, the time T1 of the leaving history table 103*a* is updated to "12:10". However, unlike the example shown in FIG. 8B above, when it is first detected that the recording paper sheet is left unremoved, it is not determined that the leaving time exceeds in this example.

Each MFP continuously detects using the leaving detecting portion whether the recording paper sheets discharged/stacked in the paper discharge tray are left unremoved (second time). If the MFP 1 detects that the recording paper sheets of the JOB1 are left unremoved, the leaving information of the JOB1 (the job number and the MFP number) is transmitted to the management server 10, and a reception time of the information at the management server 10 (12:40 in this case) is registered in the leaving history table 103*a*. That is, as shown in FIG. 9C, the time T2 of the leaving history table 103*a* is updated to "12:40". The leaving time (T2−T1) of the JOB1 is then calculated and if this leaving time is equal to or longer than a predetermined time (20 minutes in this case), the leaving time excess flag is updated to "exceed".

As above, after the recording paper sheet left unremoved is detected (first time), when it is detected that the recording paper sheet is left unremoved for a predetermined time or longer (second time), it is determined that the leaving time is over and this is recorded in the leaving history table 103*a* in this example. If the paper sheet left unremoved is not detected for the second time or if the leaving time (T2−T1) is shorter than the predetermined time even when the paper sheet left unremoved is detected for the second time, it is not determined that the leaving time is over.

Each MFP then continuously detects with the leaving detecting portion whether the recording paper sheets discharged/stacked in the paper discharge tray are left unremoved (third time). On this occasion, if the MFP 1 does not detect the recording paper sheets left unremoved (third time) since the recording paper sheets of the JOB1 are removed by a user, the leaving information (the job number and the MFP number) is transmitted to the management server 10 without detecting the recording paper sheets left. Although the leaving information is received by the management server 10 at "13:10" as shown in FIG. 9D, since the recording paper sheet left unremoved was not detected, the update processing is not executed for the leaving history table 103*a* and it remains as it is.

FIG. 10 depicts an example of the leaving count table 103*b* created and updated by the management server 10. The creating/updating processing of the leaving count table 103*b* shown in this example is executed by the leaving information count portion 102*b* included in the management server 10.

Based on the leaving information registered in the leaving history table 103*a*, the leaving information count portion 102*b* creates and updates the leaving count table 103*b*, which is a table for managing how many times and when the leaving occurred and a name of a user who caused it. Administrators, etc., are able to know how many times the leaving was caused by what user, in what MFP, and in what time zone by referring to the leaving count table 103*b*.

For example, in the case of the example shown in FIGS. 8A and 8B, the leaving information count portion 102*b* counts the number of print jobs associated with the detection of the recording paper sheet left unremoved for each time zone (morning/afternoon in this example) or for each image forming apparatus (MFP 1/MFP 2 in this example) based on the leaving detection time (time T1) and the user ID registered in the leaving history table 103*a* to create the leaving count table 103*b*. This leaving count table 103*b* is updated in conjunction with the update of the leaving history table 103*a*.

In the case of the example shown in FIGS. 9A to 9D, the leaving information count portion 102*b* counts the number of print jobs associated with the detection of the recording paper sheets left unremoved for a predetermined time or longer after the first detection that the recording paper sheet is left for each time zone (morning/afternoon) or for each image forming apparatus (MFP 1/MFP 2) based on the leaving detection time (time T1 or time T2) and the user ID registered in the leaving history table 103*a* to create the leaving count table 103*b*.

In the case of the leaving count table 103*b* shown in FIG. 10, the total number of times of leaving is 14 for the user with the user ID "C12345", and in this counting result, the leaving occurs 11 times in the morning and 3 times in the afternoon and occurs 12 times in the MFP 1 and 2 times in the MFP 2 in this counting result. The same counting processing is executed for each user ID.

Figure 11:
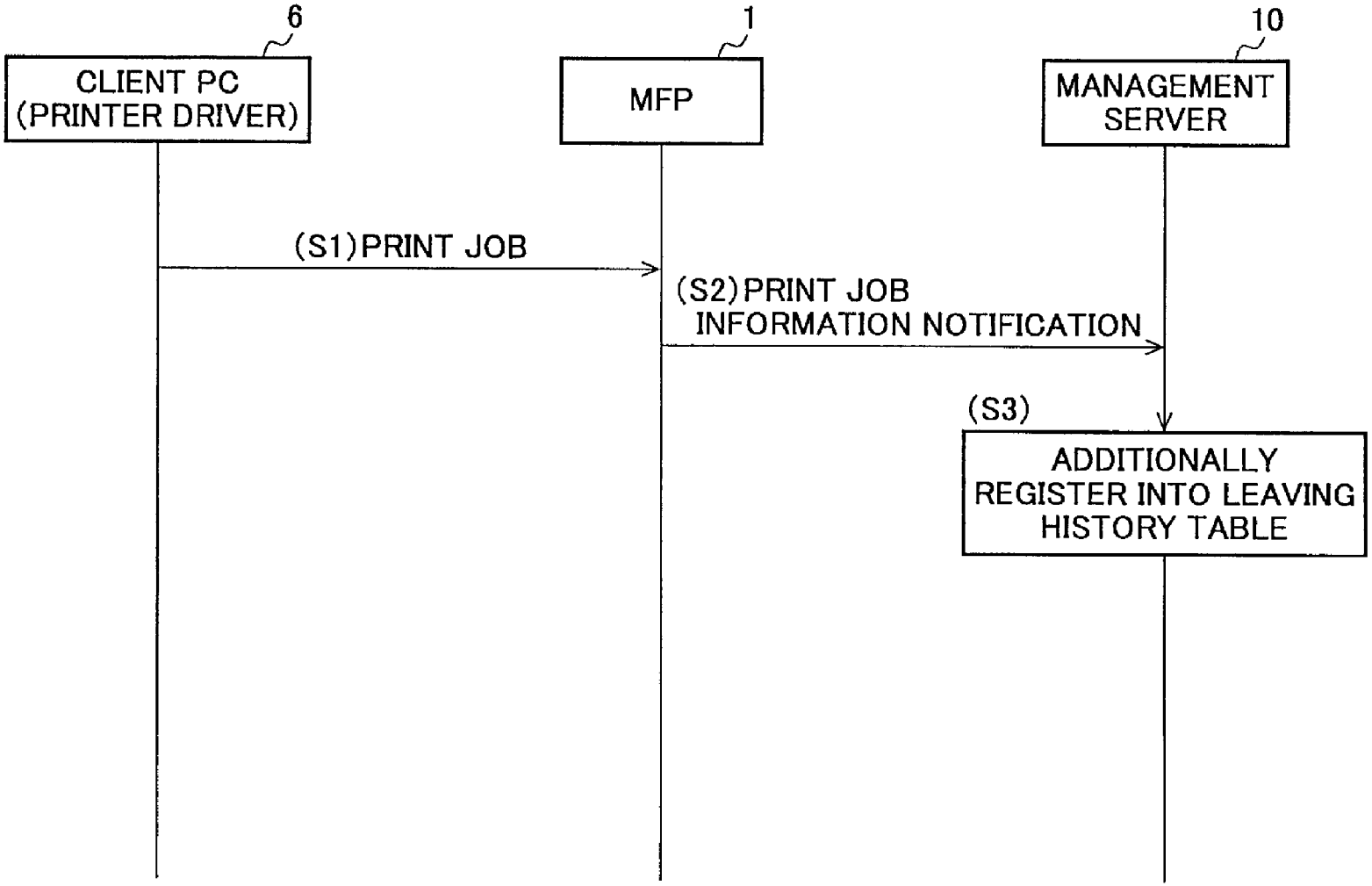
FIG. 11 is an explanatory view of a flow of a warning processing based on a counting processing and a counted result of leaving information in the print managing system of the present invention.
Figure 12:
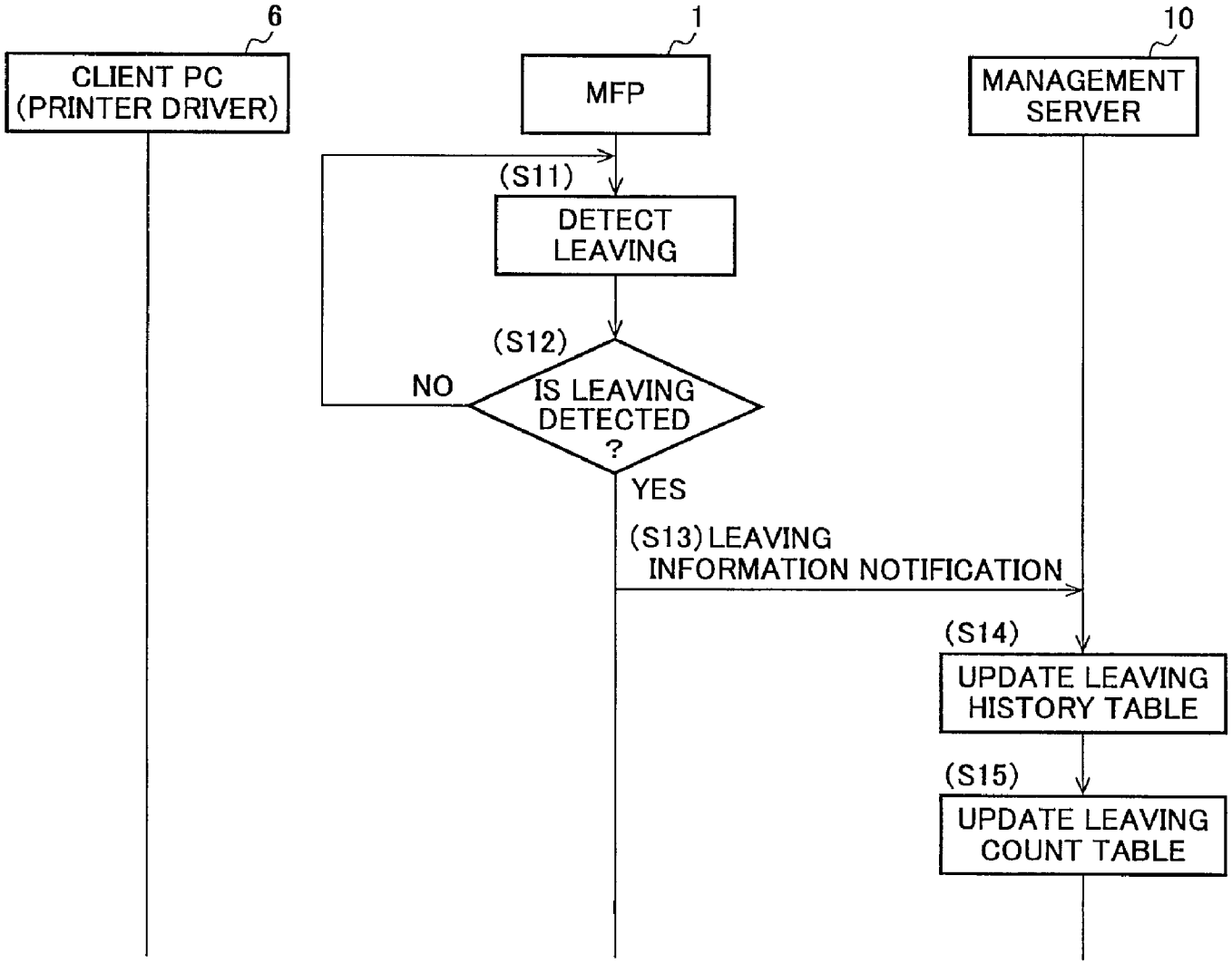
FIG. 12 is an explanatory view of a flow of the warning processing based on the counting processing and the counted result of the leaving information in the print managing system of the present invention.
Figure 13:
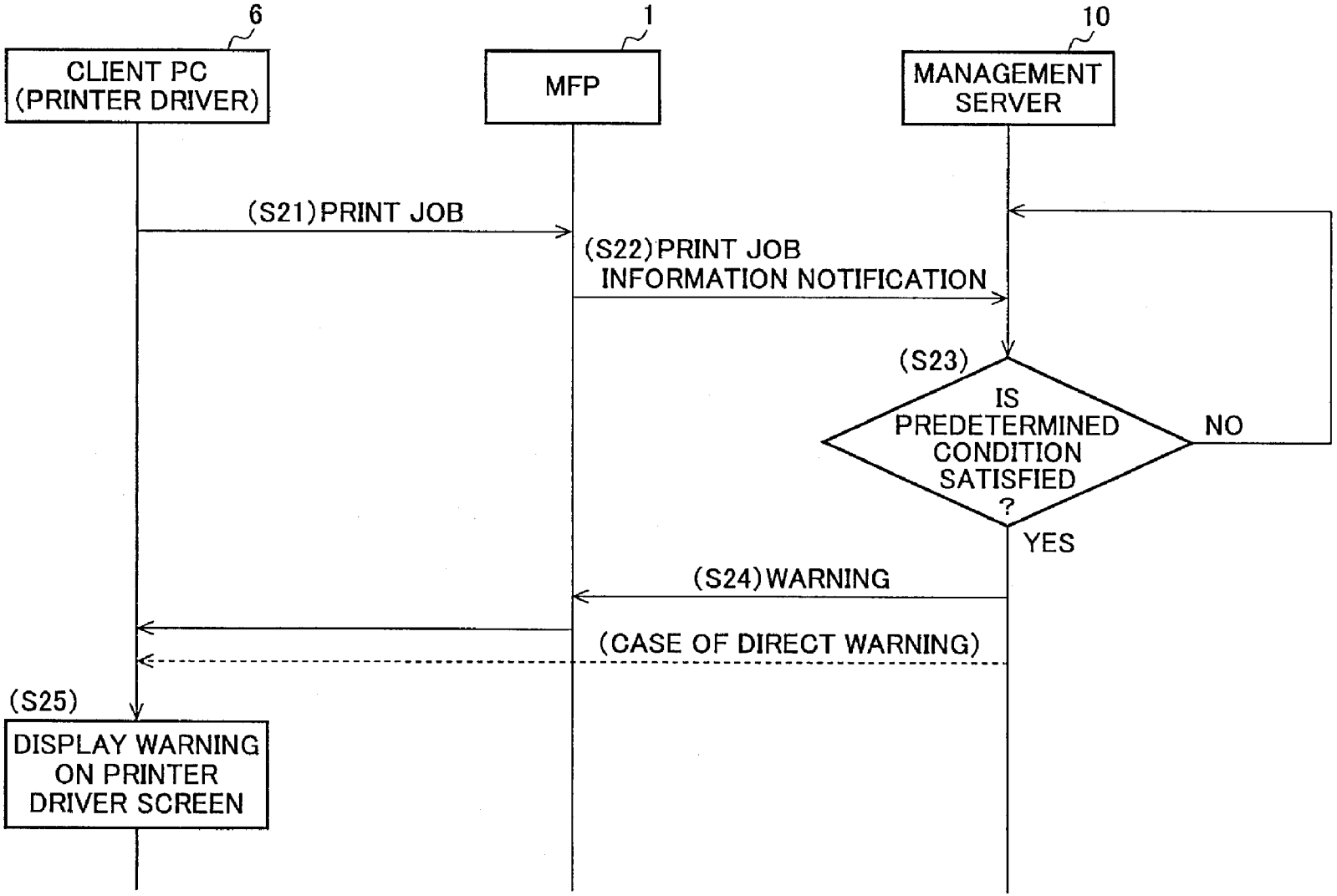
FIG. 13 is an explanatory view of a flow of the warning processing based on the counting processing and the counted result of the leaving information in the print managing system of the present invention.

FIGS. 11 to 13 are explanatory views of a flow of the warning processing based on the counting processing and the counted result of the leaving information in the print managing system of the present invention.

In FIG. 11, the client PC 6 transmits a print job converted from document data by the printer driver to the MFP 1 specified as an output destination (S1). The MFP 1 transmits to the management server 10 the print job information including a job number, a user ID, and an MFP number (S2). The management server 10 additionally registers the job number, the user ID, and the MFP number received from the MFP 1 into the leaving history table 103*a* (S3).

In FIG. 12, after the output of the print job from the client PC 6 is completed, the MFP 1 executes the processing of detecting that a recording paper sheet discharged/stacked in the paper discharge tray is left unremoved (S11). It is determined whether a recording paper sheet is left unremoved (S12), and if a sheet left unremoved is detected (YES), the leaving information including the job number and the MFP number is transmitted to the management server 10 (S13). On the other hand, if a sheet left unremoved is not detected (NO), the flow goes back to S11 and is shifted to the leaving detection waiting state.

The management server 10 updates the leaving history table 103*a* based on the leaving information (the job number and the MFP number) from the MFP 1 (S14) and also updates the leaving count table 103*b* (S15).

In FIG. 13, when the client PC 6 transmits a print job to the MFP 1 (S21), the MFP 1 transmits to the management server 10 the print job information including a user ID and an output destination MFP associated with the print job (S22). The management server 10 searches the leaving count table 103*b* for a counted result corresponding to the user ID and determines whether the counted result satisfies a predetermined condition (S23).

At S23, for example, when referring to the leaving count table 103*b*, if a predetermined number (e.g., 10) is exceeded by the total number of times of leaving by the user corresponding to the user ID (YES), a warning is given directly or through the MFP 1 to the client PC 6 (S24). A warning may be given if the total number of times of leaving exceeds 10 times in the MFP specified as the output destination of the print job. A warning may be given if the total number of times of leaving exceeds 10 times in the time zone (such as morning/afternoon) including the time when the print job is accepted. On the other hand, if the total number of times of leaving does not exceed the predetermined number (e.g., 10) in each of the above cases in the leaving count table 103*b* at S23 (NO), the flow is shifted to the input waiting state for the print job information.

Finally, the client PC 6 receives the warning information from the management server 10 and displays a warning message included in the warning information on the screen of the printer driver as shown in FIG. 7 (S25).

As above, for a user having the number counted by the leaving information count portion 102*b* equal to or greater than a predetermined number, when accepting a print job from the client PC 6 of that user, the warning portion 105 included in the management server 10 transmits the warning information to the client PC 6 of the user. For a user having the number in a certain time zone (e.g., morning) counted by the leaving information count portion 102*b* equal to or greater than a predetermined number, if a time accepting a print job from the client PC 6 of that user is included in the certain time zone (morning), the warning portion 105 may transmit the warning information to the client PC 6 of the user. For a user having the number in a certain MFP (e.g., the MFP 1) counted by the leaving information count portion 102*b* equal to or greater than a predetermined number, if an output destination specified by a print job from the client PC 6 of that user is the certain MFP (MFP 1), the warning portion 105 may transmit the warning information to the client PC 6 of the user.

Figure 14:
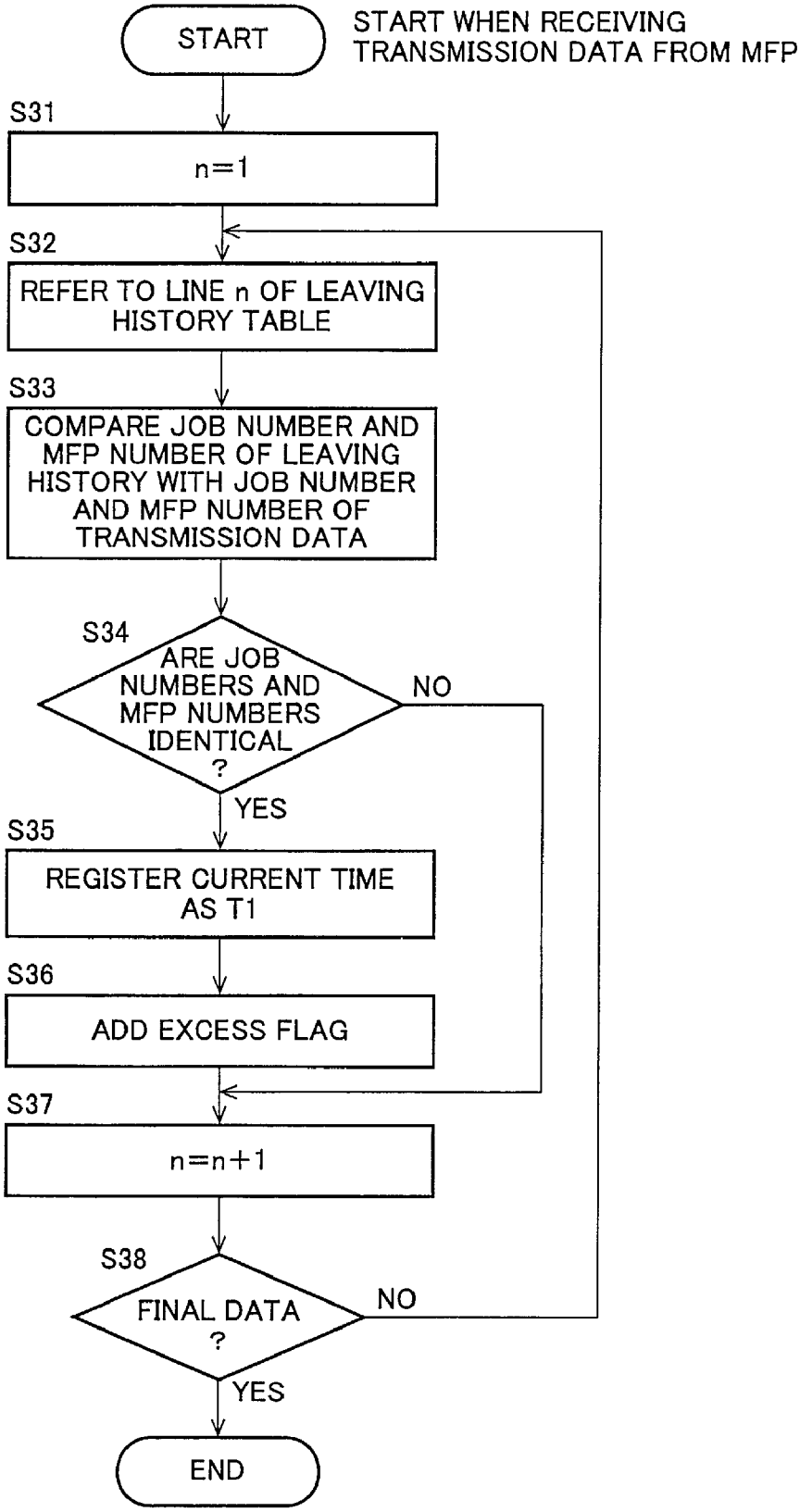
FIG. 14 is an explanatory flowchart of an example of the processing of a registration to the leaving history table by the management server.

FIG. 14 is an explanatory flowchart of an example of a registration processing to the leaving history table by the management server 10. The processing of the example corresponds to the example shown in FIGS. 8A and 8B and is started when the MFP 1 detects that a recording paper sheet is left unremoved and the transmission data (the leaving information: a job number and an MFP number) from the MFP 1 are received.

The leaving information count portion 102*b* included in the management server 10 sets n=1 for the nth line of the leaving history table 103*a* (step S31) and refers to the nth line of the leaving history table 103*a* (step S32). The leaving information count portion 102*b* compares the job number and the MFP number in the leaving history table 103*a* with the job number and the MFP number included in the transmission data from the MFP 1 (step S33).

The leaving information count portion 102*b* determines whether the job numbers and the MFP numbers are identical (step S34) and if the numbers are identical (YES), the leaving information count portion 102*b* sets the current time as the time T1 of the leaving history table 103*a* (step S35) and adds an excess flag. The leaving information count portion 102*b* sets n=n+1 for the nth line of the leaving history table 103*a* (step S37). If the numbers are not identical at step S34 (NO), the flow goes to step S37 to set n=n+1 for the nth line of the leaving history table 103*a*.

The leaving information count portion 102*b* lastly determines whether the data are the final data in the leaving history table 103*a* (step S38), and if it is determined that the data are the final data (YES), the flow is simply terminated. If it is determined that the data are not the final data at step S38, the flow goes back to step S32 to repeat the processing.

Figure 15:
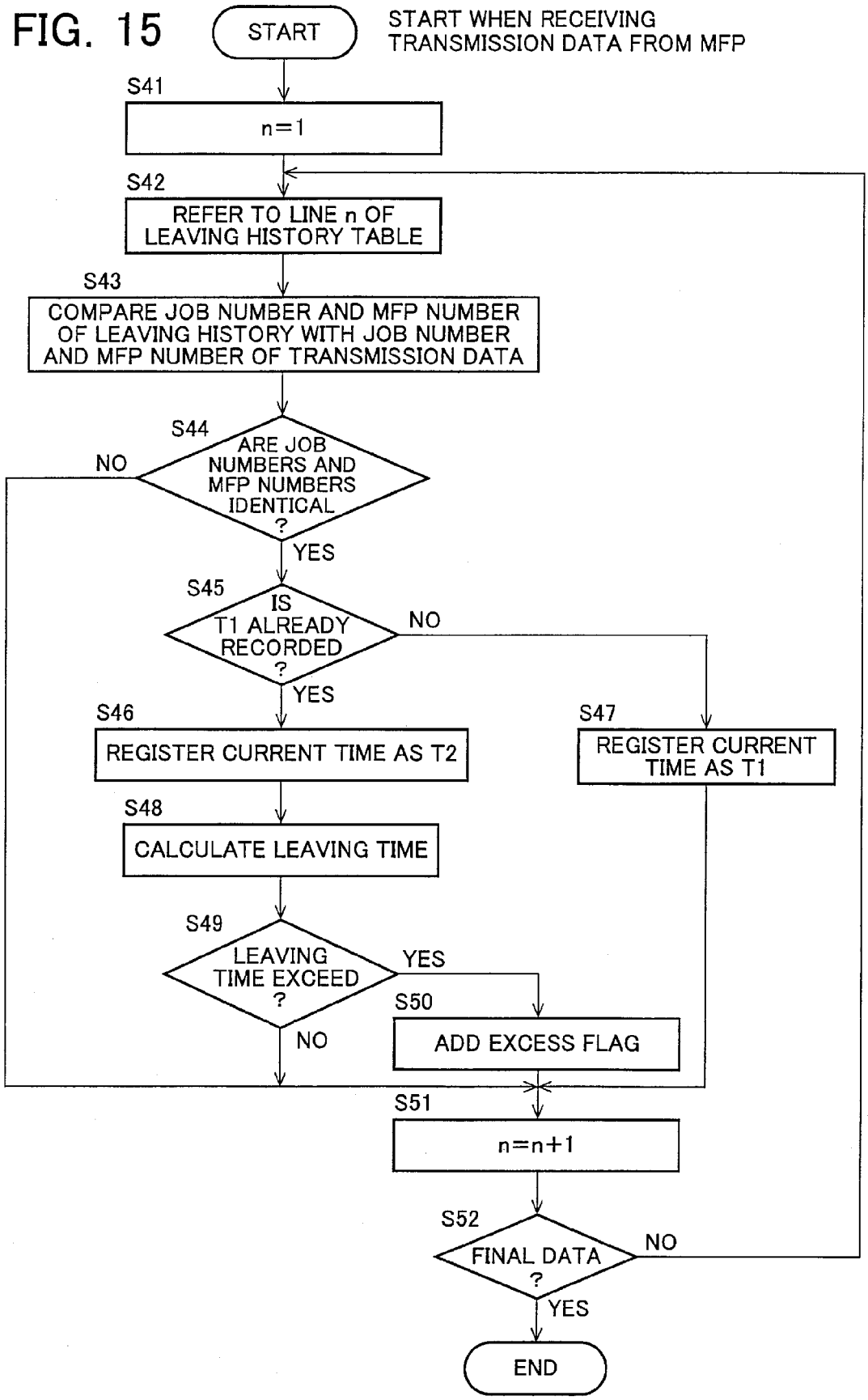
FIG. 15 is an explanatory flowchart of another example of the processing of a registration to the leaving history table by the management server.

FIG. 15 is an explanatory flowchart of another example of the registration processing to the leaving history table 103*a* by the management server 10. The processing of the example corresponds to the example shown in FIGS. 9A and 9B and is started when the MFP 1 detects that a recording paper sheet is left unremoved and the transmission data (the leaving information: a job number and an MFP number) from the MFP 1 are received.

The leaving information count portion 102*b* included in the management server 10 sets n=1 for the nth line of the leaving history table 103*a* (step S41) and refers to the nth line of the leaving history table 103*a* (step S42). The leaving information count portion 102*b* compares the job number and the MFP number in the leaving history table 103*a* with the job number and the MFP number included in the transmission data from the MFP 1 (step S43).

The leaving information count portion 102*b* determines whether the job numbers and the MFP numbers are identical (step S44) and if the numbers are identical (YES), it is determined whether the time T1 is already recorded in the leaving history table 103*a* (step S45). If the time T1 is already recorded (YES), the current time is recorded as the time T2 in the leaving history table 103*a* (step S46). If the numbers are not identical at step S44 (NO), the flow goes to step S51 to set n=n+1 for the nth line of the leaving history table 103*a*. If the time T1 is not recorded at step S45 (NO), the current time is recorded as the time T1 (step S47) and the flow goes to step S51.

After registering the current time as the time T2 at step S46, the leaving information count portion 102*b* calculates the leaving time from the time T2−T1 (step 548) to determine whether the calculated leaving time exceeds a predetermined time (step S49). If the leaving time exceeds a predetermined time (YES), the excess flag is added (step S50). The nth line of the leaving history table 103*a* is then set to n=n+1 (step S51). If the leaving time does not exceed a predetermined time (NO), the flow goes to step S51.

The leaving information count portion 102*b* lastly determines whether the data are the final data in the leaving history table 103*a* (step S52), and if it is determined that the data are the final data (YES), the flow is simply terminated. If it is determined that the data are not the final data at step S52, the flow goes back to step S42 to repeat the processing.

Figure 16:
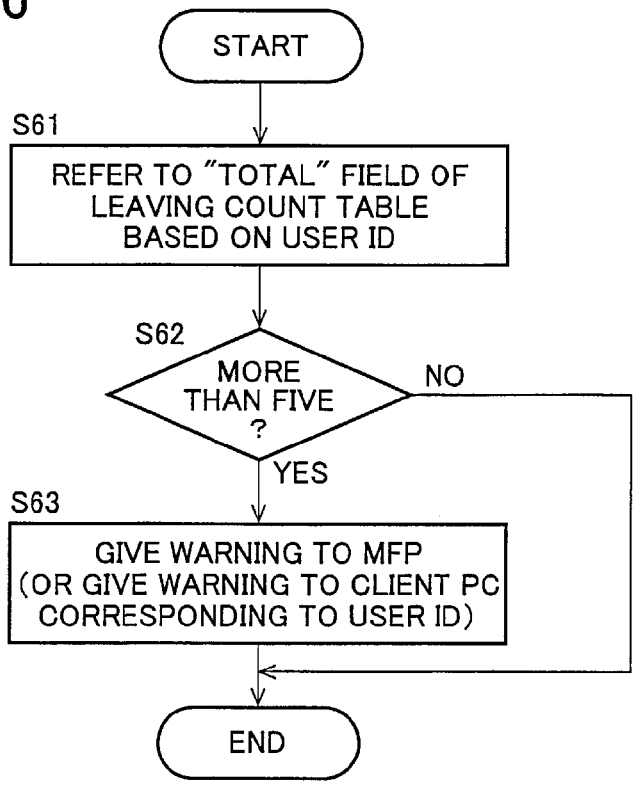
FIG. 16 is an explanatory flowchart of an example of the processing of a warning to the client PC by the management server.

FIG. 16 is an explanatory flowchart of an example of a warning processing to the client PC 6 by the management server 10. When the print job from the client PC 6 is executed, the controlling portion 102 included in the management server 10 refers to the "total" field of the leaving history table 103*a* based on the user ID (step S61) to determine whether the counted number exceeds a predetermined number (five in this case) (step S62). If the counted number exceeds five (YES), the warning portion 105 gives a warning directly or through the MFP 1 to the client PC 6 corresponding to the user ID based on the controlling portion 102 (step S63). If the counted number does not exceed five at step S62 (NO), no warning is given and the flow is simply terminated.

Figure 17:
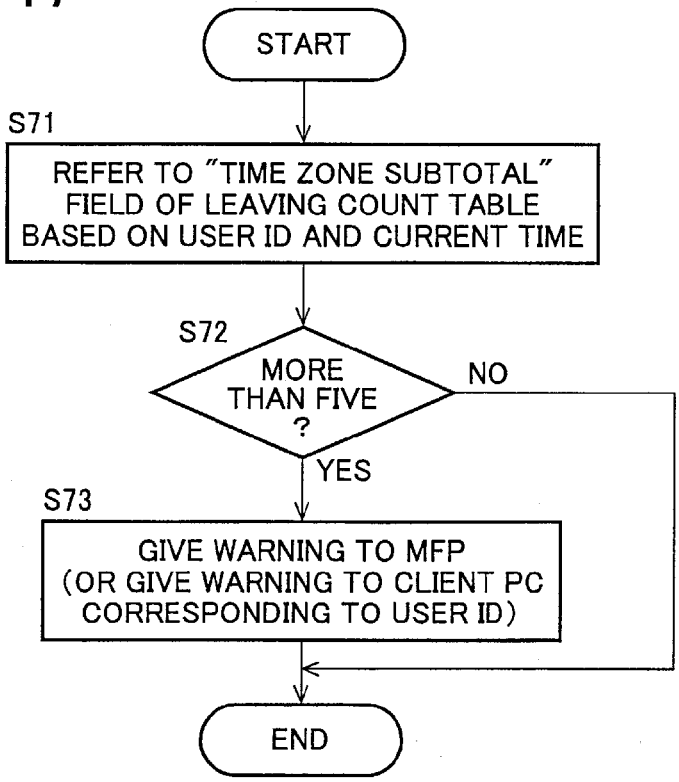
FIG. 17 is an explanatory flowchart of another example of the processing of a warning to the client PC by the management server.

FIG. 17 is an explanatory flowchart of another example of the warning processing to the client PC 6 by the management server 10. When the print job from the client PC 6 is executed, the controlling portion 102 included in the management server 10 refers to the "time-zone subtotal" of the leaving history table 103*a* based on the user ID and the current time (step S71) to determine whether the counted number exceeds a predetermined number (five in this case) (step S72). If the counted number exceeds five (YES), the warning portion 105 gives a warning directly or through the MFP 1 to the client PC 6 corresponding to the user ID based on the controlling portion 102 (step S73). If the counted number does not exceed five at step S72 (NO), no warning is given and the flow is simply terminated.

Figure 18:
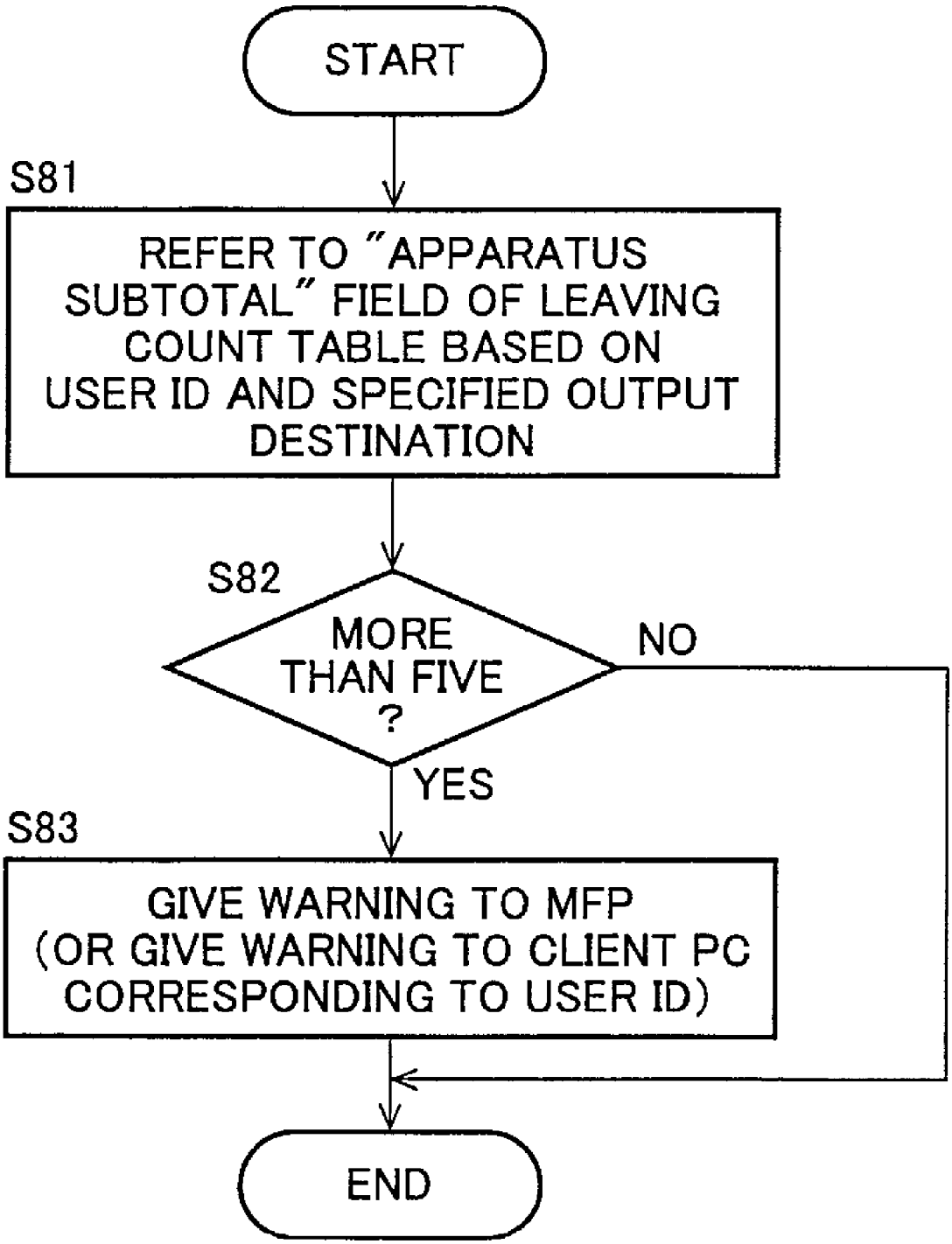
FIG. 18 is an explanatory flowchart of another example of the processing of a warning to the client PC by the management server.

FIG. 18 is an explanatory flowchart of another example of the warning processing to the client PC 6 by the management server 10. When the print job from the client PC 6 is executed, the controlling portion 102 included in the management server 10 refers to the "apparatus subtotal" of the leaving history table 103*a* based on the user ID and the specified output destination (step S81) to determine whether the counted number exceeds a predetermined number (five in this case) (step S82). If the counted number exceeds five (YES), the warning portion 105 gives a warning directly or through the MFP 1 to the client PC 6 corresponding to the user ID based on the controlling portion 102 (step S83). If the counted number does not exceed five at step S82 (NO), no warning is given and the flow is simply terminated.

FIGS. 19A and 19B are explanatory views of an example of a method of creating/updating the leaving history table 103*a* of the management server 10. The creating/updating processing of the leaving history table 103*a* shown in this example is executed by the leaving information count portion 102*b* included in the management server 10.

In FIG. 19A, when a print job is executed by the client PC 6, the MFP 1 or the MFP 2 accepted the print job transmits to the management server 10 the job information such as a job number, a user ID, an MFP number, and the information indicating that the print job is important (hereinafter, degree of importance information). The management server 10 registers the job information such as the job number, the user ID, the MFP number, and the degree of importance information into the leaving history table 103*a*. Although this job information is included in the leaving information of the present invention, each MFP transmits a job number, a user ID, an MFP number, and degree of importance information to the management server 10 at the time of the registration, and each MFP transmits a job number and an MFP number to the management server 10 at the time of the leaving detection described later.

In this example, items of the leaving history table 103*a* are a job number, a user ID, an MFP number, degree of importance information, a time T1 when the presence of a recording paper sheet is initially detected, and a leaving time excess flag and are created/updated based on the job information from the MFP 1 or the MFP 2. In this example, it is registered in the order of the job number, the user ID, the MFP number, and the degree of importance information like "JOB1, C12345, MFP1, (importance) high" and "JOB2, C54321, MFP2". This registration processing is performed each time when a print job is executed.

The degree of importance information is the information representing "confidentiality" or "secret" added in advance to document data stored in a hard disk (HD) of the client PC 6 or document data attached to e-mails. The client PC 6 extracts this degree of importance information when converting the document data into a print job with the printer driver and transmits the information to the management server 10 along with the print job.

After outputting the print jobs accepted by the MFPs, each MFP detects regularly or at arbitrary timing with the leaving detecting portion whether the recording paper sheets discharged/stacked in the paper discharge tray are left unremoved. For example, if the MFP 1 detects that the recording paper sheets of the JOB1 are left unremoved, the leaving information of the JOB1 (the job number and the MFP number in this case) is transmitted to the management server 10, and a reception time at the management server 10 (12:10 in this case) is registered into the leaving history table 103*a*. The leaving information is transmitted only for the JOB1 associated with the recording paper sheets left unremoved in the paper discharge tray, and the leaving information of the JOB2 is not transmitted since the leaving is not detected.

As shown in FIG. 19B, the time T1 of the leaving history table 103*a* is updated to "12:10" and the leaving time excess flag is updated to "exceed". As above, when it is detected that the recording paper sheet is left unremoved, it is immediately determined that the leaving time exceeds and this is recorded on the leaving history table 103*a* in this example.

FIGS. 20A and 20B are explanatory views of another example of the leaving count table 103*b* created/updated by the management server 10. The creating/updating processing of the leaving count table 103*b* shown in this example is executed by the leaving information count portion 102*b* included in the management server 10.

In the case of the example shown in FIGS. 19A and 19B above, if the print job accepted by the MFP 1 includes the degree of importance information (i.e., importance "high") and the degree of importance information is registered in the leaving history table 103*a*, the leaving information count portion 102*b* may separately count the leaving information including the degree of importance information and other pieces of the leaving information for each user. FIGS. 20A and 20B show an example of the leaving history table 103*a* separately tabulated depending on the degree of importance information for each user ID. If the print job accepted by the MFP 1 includes the degree of importance information and the degree of importance information is registered in the leaving history table 103*a*, the leaving information count portion 102*b* may count only the leaving information including the degree of importance information for each user as shown in FIG. 20B.

By creating/updating this leaving count table 103*b*, a user tending to leave the especially important print jobs in a paper discharge tray can be identified in a print job. The leaving counting processing can efficiently be executed by counting the leaving histories specifically for the important print job.

For a user having the counted number in the leaving count table 103*b* shown in FIGS. 20A and 20B equal to or greater than a predetermined number, when the degree of importance information is included in a print job from the client PC 6 of the user, the warning portion 105 may transmit the warning information to the client PC 6 based on the control of the controlling portion 102.

Alternatively, for a user having the counted number equal to or greater than a predetermined number as the counted result of the leaving count table 103*b* shown in FIG. 20B, when the degree of importance information is included in a print job from the client PC 6 of the user, the warning portion 105 may transmit the warning information to the client PC 6 based on the control of the controlling portion 102.

Figure 21:
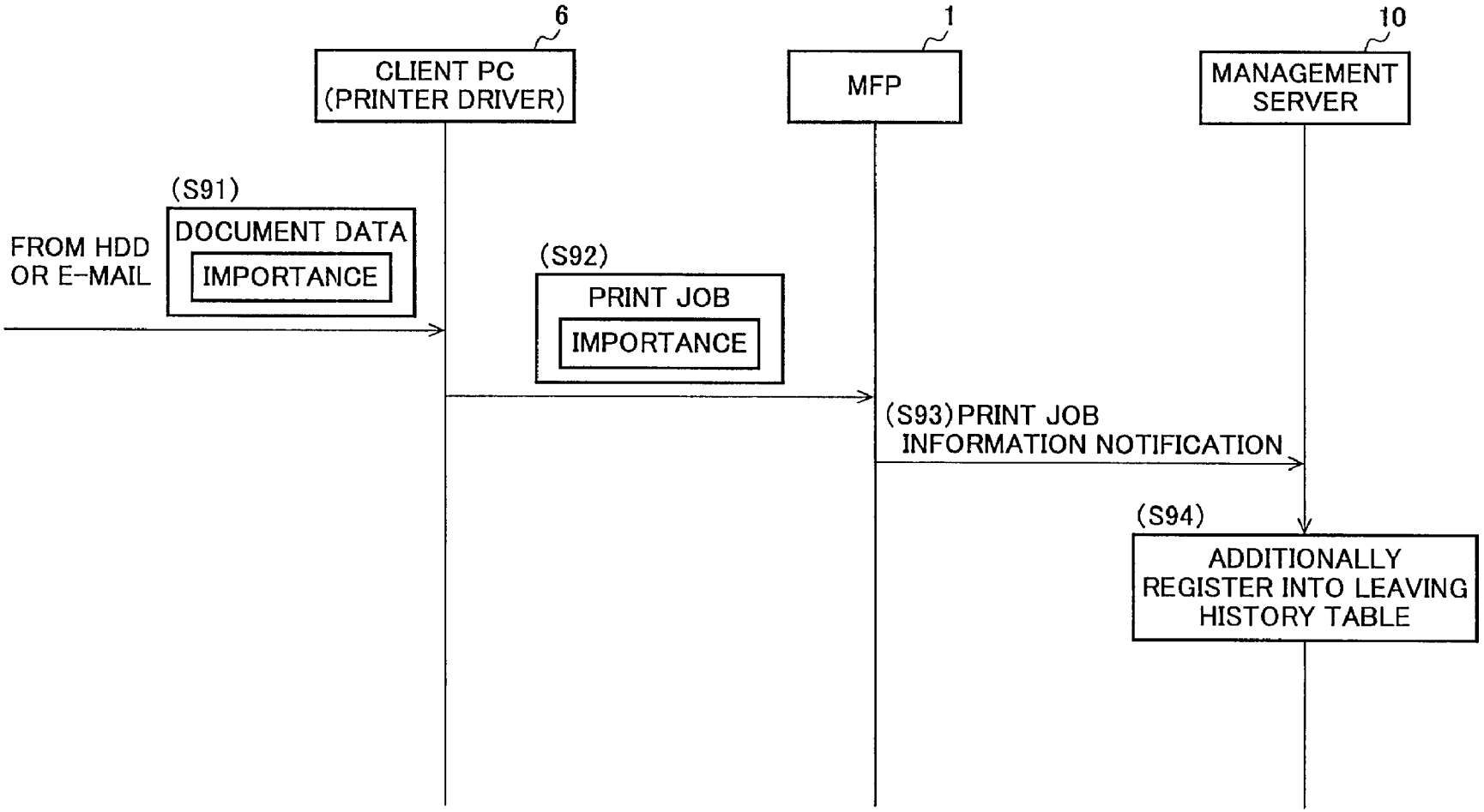
FIG. 21 is an explanatory view of another example of a flow of the warning processing based on the counting processing and the counted result of the leaving information in the print managing system of the present invention.
Figure 22:
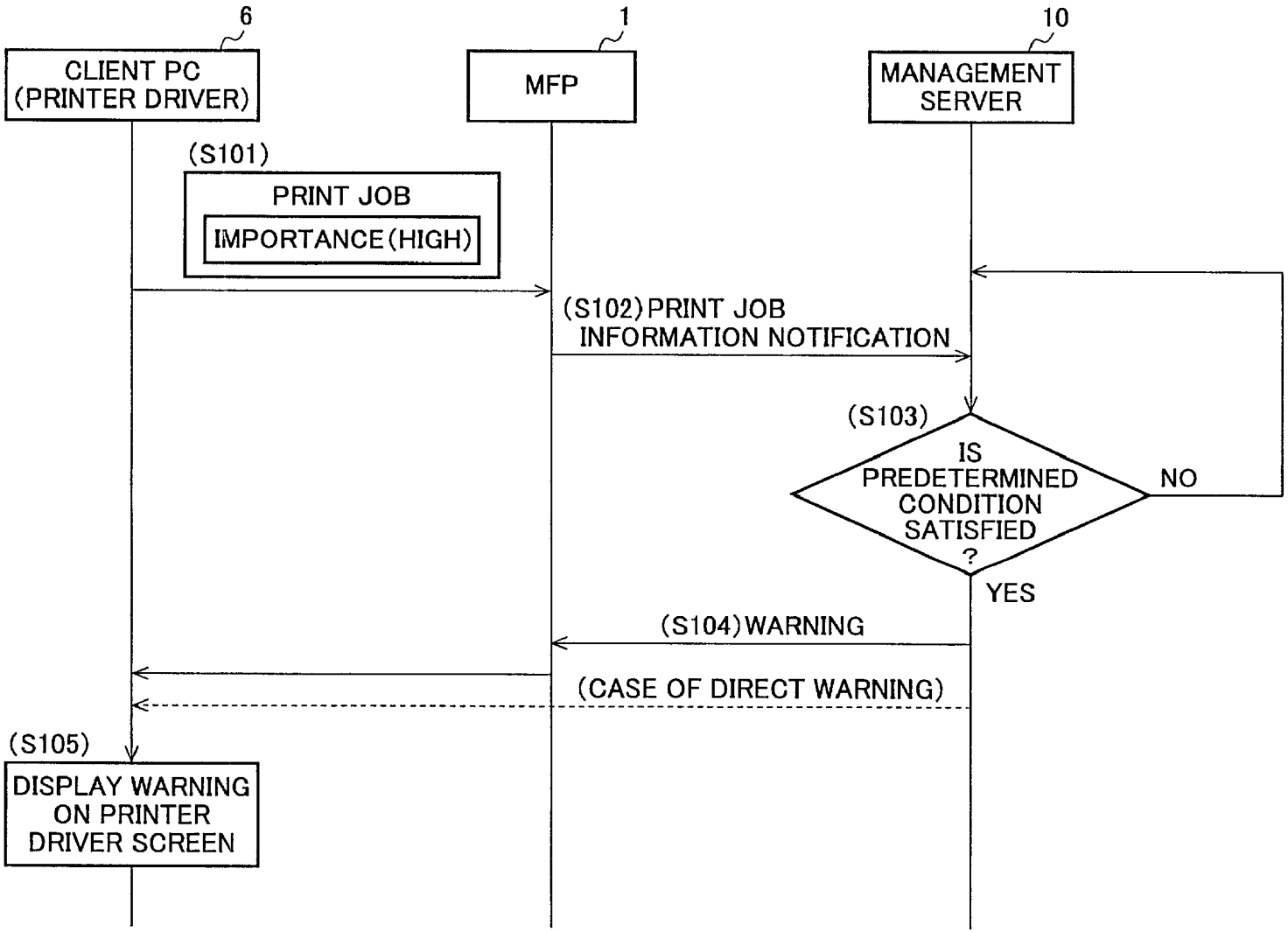
FIG. 22 is an explanatory view of another example of a flow of the warning processing based on the counting processing and the counted result of the leaving information in the print managing system of the present invention.

FIGS. 21 and 22 are explanatory views of another example of a flow of the warning processing based on the counting processing and the counted result of the leaving information in the print managing system of the present invention.

In FIG. 21, the client PC 6 acquires document data with the degree of importance information added from an HDD or e-mail (S91) and transmits a print job (including the degree of importance information) converted from the document data by the printer driver to the MFP 1 specified as an output destination (S92). The MFP 1 transmits to the management server 10 the print job information including a job number, a user ID, an MFP number, and the degree of importance information (S93). The management server 10 additionally registered the job number, the user ID, the MFP number, and the degree of importance information received from the MFP 1 into the leaving history table 103*a* (S94).

After the output of the print job from the client PC 6 is completed, the MFP 1 executes a processing of detecting that a recording paper sheet discharged/stacked in the paper discharge tray is left unremoved. It is determined whether a recording paper sheet is left unremoved and if a sheet left unremoved is detected, the leaving information including the job number and the MFP number is transmitted to the management server 10. The management server 10 updates the leaving history table 103*a* based on the leaving information (the job number and the MFP number) from the MFP 1 and also updates the leaving count table 103*b*.

In FIG. 22, when the client PC 6 transmits a print job including the degree of importance information to the MFP 1 (S101), the MFP 1 transmits to the management server 10 the print job information including a user ID, an output destination MFP, and the degree of importance information associated with the print job (S102). The management server 10 searches the leaving count table 103*b* for a counted result corresponding to the user ID and determines whether the counted result satisfies a predetermined condition (S103).

At S103, for example, when referring to the leaving count table 103*b*, if a predetermined number (e.g., 10) is exceeded by the total number of times of leaving of the user corresponding to the user ID and the importance of the print job is "high" (YES), a warning is given directly or through the MFP 1 to the client PC 6 (S104). On the other hand, if the total number of times of leaving does not exceed the predetermined number (e.g., 10) in the above case in the leaving count table 103*b* at S103 (NO), the flow is shifted to the input waiting state for the print job information.

Finally, the client PC 6 receives the warning information from the management server 10 and displays the warning message included in the warning information on the screen of the printer driver as shown in FIG. 7 (S105).

As above, for a user having the counted amounts by the leaving information count portion 102*b* equal to or greater than a predetermined number, the warning portion 105 included in the management server 10 is configured to transmit the warning information to the client PC 6 of the user if the print job from the client PC 6 of that user includes the degree of importance information, i.e., if the degree of importance information is "high".

Although the embodiments have been described with a focus on the function of the print managing apparatus and system of the present invention, the present invention may have the form of a print managing method described as a method of executing the steps of the print managing apparatus. Similarly to the print managing apparatus having the functions, the present invention may have the form of a print managing program driving a computer to function as the print managing apparatus and the form of a recording medium having the print managing program recorded thereon.

A recording medium having stored thereon the program and data for implementing the print management function according to the present invention will be described. It is contemplated that the recording media specifically include CD-ROM (-R/-RW), magnetic optical discs, DVD-ROM (-R/-RW/-RAM), FD, HD, BD, flash memories, memory cards, memory sticks, and other various ROM and RAM, and the program for driving a computer to function as the apparatus of the above embodiments of the present invention and implementing the print management function is recorded on these recording media and distributed to facilitate the implementation of the functions. The print management function according to the present invention can be implemented by mounting the above recording medium on an information processing apparatus such as a computer to read the program by the information processing apparatus or by storing the program in a storage medium included in the information processing apparatus to read the program as needed.

As described above, according to the present invention, since the leaving situations can be counted from the leaving history of each user and a warning notification can be given to a user who frequently left discharged paper sheets in the tray based on the counted result when accepting a print job, the leaving itself can be prevented.

According to the present invention, since the leaving situations can be counted from the leaving history of each user and a warning notification can be given to a user who frequently left discharged paper sheets in the tray based on the counting result when accepting a print job, the leaving itself can be prevented.

The invention claimed is:

1. A print managing apparatus that can be connected through a network to an image forming apparatus having a leaving detecting portion to detect that a recording paper sheet discharged/stacked in a paper discharge tray is left in the tray, the apparatus comprising:

a leaving information acquiring portion that acquires a respective leaving information for each print job accepted by the image forming apparatus resulting in recording paper sheets being left in the paper discharge tray for a predetermined time or longer;

a leaving information count portion that counts for each user the number of times the respective leaving information is acquired by the leaving information acquiring portion; and a warning portion that, upon receiving a print job from a terminal apparatus of a user for whom the number of times the respective leaving information has previously been acquired is equal to or greater than a predetermined number, transmits warning information to the terminal apparatus of the user prompting the user not to leave a recording sheet in the paper discharge tray.

2. The print managing apparatus as defined in claim 1, wherein the respective leaving information includes a leaving detection time, which is a time when the image forming apparatus detects that the recording paper sheet is left in the paper discharge tray.

3. The print managing apparatus as defined in claim 1, wherein the respective leaving information includes a user ID for identifying a user who leaves the recording paper sheet in the tray.

4. The print managing apparatus as defined in claim 1, wherein the leaving information acquiring portion acquires a leaving detection time, which is a time when the image forming apparatus detects that the recording paper sheet is left in the paper discharge tray, and a user ID for identifying a user who leaves the recording paper sheet in the tray as the respective leaving information, and wherein the leaving information count portion counts the number of print jobs associated with the detection of the recording paper sheets left in the tray for a time zone based on the leaving detection time and the user ID.

5. The print managing apparatus as defined in claim 1, wherein the leaving information acquiring portion acquires a leaving detection time, which is a time when the image forming apparatus detects that the recording paper sheet is left unremoved, and a user ID for identifying a user who leaves the recording paper sheet in the tray as the respective leaving information, and wherein the leaving information count portion counts the number of print jobs associated with the detection of the recording paper sheets left in the tray for a predetermined time or longer after the first detection of leaving for a time zone based on the leaving detection time and the user ID.

6. The print managing apparatus as defined in claim 1, wherein the leaving information acquiring portion acquires a leaving detection time, which is a time when the image forming apparatus detects that the recording paper sheet is left in the paper discharge tray, and a user ID for identifying a user who leaves the recording paper sheet in the tray as the respective leaving information, and wherein the leaving information count portion counts the number of print jobs associated with the detection of the recording paper sheets left in the tray for every image forming apparatus based on the leaving detection time and the user ID.

7. The print managing apparatus as defined in claim 1, wherein the leaving information acquiring portion acquires a leaving detection time, which is a time when the image forming apparatus detects that the recording paper sheet is left in the paper discharge tray, and a user ID for identifying a user who leaves the recording paper sheet in the tray as the respective leaving information, and wherein the leaving information count portion counts the number of print jobs associated with the detection of the recording paper sheets left unremoved for a predetermined time or longer after the recording paper sheet is left for every image forming apparatus based on the leaving detection time and the user ID.

8. The print managing apparatus as defined in claim 1, wherein the warning portion transmits the warning information to a terminal apparatus of a user having the number counted by the leaving information count portion for a specified time zone equal to or greater than a predetermined number, if the time when the apparatus received a print job from the terminal apparatus of the user is in the specified time zone.

9. The print managing apparatus as defined in claim 1, wherein the warning portion transmits the warning information to a terminal apparatus of a user having a number of specified image forming apparatuses counted by the leaving information count portion equal to or greater than a predetermined number, if an output destination designated by a print job from the terminal apparatus of the user is any of the specified image forming apparatuses.

10. The print managing apparatus as defined in claim 1, wherein if a print job accepted by the image forming apparatus includes information indicating that the print job is important, the leaving information count portion counts only the respective leaving information including the information indicating the importance for every user.

11. The print managing apparatus as defined in claim 10, wherein the warning portion transmits the warning information to a terminal apparatus of a user having the counted number of the respective leaving information including the information indicating the importance equal to or greater than a predetermined number as the counted result by the leaving information count portion, if the print job from the terminal apparatus of the user includes the information indicating the importance.

12. The print managing apparatus as defined in claim 1, wherein if a print job accepted by the image forming apparatus includes information indicating that the print job is important, the leaving information count portion separately counts the respective leaving information including the information indicating the importance and other pieces of the respective leaving information for every user.

13. The print managing apparatus as defined in claim 12, wherein the warning portion transmits the warning information to a terminal apparatus of a user having the number counted by the leaving information count portion equal to or greater than a predetermined number, if the print job from the terminal apparatus of the user includes the information indicating the importance.

14. A print managing system comprising the print managing apparatus as defined in claim 1, a terminal apparatus that transmits a print job, and an image forming apparatus having a leaving detecting portion to detect that a recording paper sheet discharged/stacked in a paper discharge tray is left in the tray, wherein the print managing apparatus, the terminal apparatus, and the image forming apparatus are connected each other through a network, the image forming apparatus transmitting to the print managing apparatus a job number of the print job, a user ID, and an identification number of the image forming apparatus when receiving a print job from the terminal apparatus, and the image forming apparatus transmitting to the print managing apparatus a job number of the print job and the identification number of the image forming apparatus that are associated with the detection of the leaving when the image forming apparatus detects that a recording paper sheet is left in the tray.

15. A program stored on non-transitory computer-readable medium for implementing the function of the print managing apparatus as defined in claim 1.

* * * * *